United States Patent [19]

Watanabe et al.

[11] Patent Number: 4,503,359

[45] Date of Patent: Mar. 5, 1985

[54] DISCHARGE LAMP LIGHTING DEVICE

[75] Inventors: Yoshio Watanabe; Hiroyuki Iyama, both of Tokyo, Japan

[73] Assignee: Hitachi Lighting, Ltd., Chiba, Japan

[21] Appl. No.: 529,127

[22] Filed: Sep. 2, 1983

Related U.S. Application Data

[63] Continuation of Ser. No. 176,687, Aug. 8, 1980.

[30] Foreign Application Priority Data

| | | | |
|---|---|---|---|
| Sep. 12, 1979 | [JP] | Japan | 54-125206[U] |
| Jan. 24, 1980 | [JP] | Japan | 55-6549[U] |
| Jan. 24, 1980 | [JP] | Japan | 55-6550[U] |
| May 16, 1980 | [JP] | Japan | 55-66217[U] |

[51] Int. Cl.[3] ..... H05B 39/00; H05B 37/00

[52] U.S. Cl. ..... 315/105; 315/207; 315/283; 315/DIG. 7

[58] Field of Search ..... 315/DIG. 7, 289, 290, 315/207, 127, 101, 103

[56] References Cited

U.S. PATENT DOCUMENTS

| | | | |
|---|---|---|---|
| 3,875,459 | 4/1975 | Remery et al. | 315/205 |
| 3,997,814 | 12/1976 | Toho | 315/200 R |
| 4,380,719 | 4/1983 | DeBijl et al. | 315/207 |
| 4,447,763 | 5/1984 | Iyama et al. | 315/290 |

*Primary Examiner*—Harold Dixon

*Attorney, Agent, or Firm*—Antonelli, Terry & Wands

[57] ABSTRACT

Disclosed is a discharge lamp lighting device which comprises a series closed-loop circuit including an AC power supply, a ballast having an inductance, and a discharge lamp, and a switch circuit in parallel to the discharge lamp. The switch circuit is turned on when the voltage across the discharge lamp is reduced to zero, and then turned off when the current flowing in the switch reaches a predetermined value. The switch circuit thus repeats its on-off operation every half cycle of the voltage across the discharge lamp. The electromagnetic energy is stored in the inductance of the ballast when the switch circuit is on, and the stored electromagnetic energy is superimposed on the source voltage and applied to the discharge lamp when the switch circuit is turned off, thus reigniting the discharge lamp every half cycle. This makes it possible to light directly a discharge lamp having a lamp voltage approximate to the source voltage.

11 Claims, 30 Drawing Figures

DISCHARGE LAMP LIGHTING DEVICE

This is a continuation of application Ser. No. 176,687, filed Aug. 8, 1980.

BACKGROUND OF THE INVENTION

1. Field of the Invention

The present invention relates to an improvement in a discharge lamp lighting device, or more in particular to an improvement in a discharge lamp lighting device of a novel type designed to enable a discharge lamp having a lamp voltage approximate to a source voltage to be lighted with a single choke.

2. Description of the Prior Art

In lighting a discharge lamp by use of a prior art lighting device with a single choke, a source voltage sufficiently high as compared with the lamp voltage is required. In recent years, however, a novel type of discharge lamp lighting device (such as disclosed in U.S. Pat. No. 3,997,814) has been suggested in which the discharge lamp can be lighted without intermediary of any step-up transformer by a source voltage as low as the lamp voltage. First, this type of lighting system will be briefly described with reference to FIG. 1. The fundamental circuit of this prior art lighting system comprises an AC power supply 1, a ballast or stabilizer 2 including an inductance and a discharge lamp 3 connected in series to each other, and a switch circuit 4 inserted between terminals A and B in parallel to the discharge lamp 3. The switch circuit 4 is closed (switched on) for a properly predetermined period thereby to store electromagnetic energy in the inductance of the ballast 2 every half cycle of the source voltage, after which the switch circuit 4 is opened (switched off) and the stored electromagnetic energy is superimposed on the source voltage. The resulting voltage is applied to the discharge lamp, thus lighting the same.

According to this lighting system, even a discharge lamp such as a 40 W fluorescent lamp of 105 V lamp voltage which cannot be lighted by an ordinary low-voltage AC power supply (such as a commercial power supply of AC 100 V) can be lighted as rated directly by the commercial power supply of AC 100 V. Further, the lighting device as a whole can be reduced both in size and in weight.

The switch circuit 4 heretofore suggested, however, is what is called the "source voltage in-phase type" in which as shown in FIG. 2 the operating signal for the switch circuit 4 is derived only from the source voltage. Specifically, it is seen from FIG. 2 that the signal S for actuating the switch circuit 4 is generated in phase with the source voltage, as shown in FIG. 3 by a switching signal generator circuit 4' inserted between the terminals a and b of the power supply 1.

As seen from FIG. 3, the phase in which the switch circuit 4 is closed generally corresponds to a time point when the source voltage $V_1$ is zero. To the extent that an inductance is used as the ballast 2, the discharge lamp 3 is still discharging and therefore the current flowing in the inductance is not yet zero at the phase where the source voltage becomes zero. By shorting the terminals of the discharge lamp 3 by closing the switch circuit 4 under this condition, considerable part of the energy stored in the inductance fails to be effectively applied to the discharge lamp and is wasted through the switch circuit 4, resulting in an insufficient circuit efficiency.

Also, in view of the fact that the operation timing of the switch circuit 4 depends on the source voltage $V_1$, a change in source voltage, ambient temperature or power frequency causes a change in the operation timing of the switch circuit 4 with respect to the actual operating condition of the discharge lamp, thereby changing the lamp output. Furthermore, a considerable power loss occurs in the switch circuit.

SUMMARY OF THE INVENTION

Accordingly, it is an object of the present invention to provide a discharge lamp lighting device having a new and novel switch circuit capable of obviating the above-mentioned disadvantages of the conventional discharge lamp lighting devices.

According to one aspect of the present invention, a switch circuit connected in parallel to a discharge lamp comprises a full-wave rectifier inserted across the discharge lamp, a unidirectional semiconductor switch element such as a SCR having a control electrode and connected between the output terminals of the full-wave rectifier, which switch element is capable of being turned off by a gate signal, and a gate control circuit for operating the semiconductor switch, means for turning on the semiconductor switch at a point in time when the voltage across the discharge lamp is reduced to zero, and means for turning off the semiconductor switch at a point in time when the current flowing in the semiconductor switch reaches a predetermined value. In other words, the primary feature of the present invention lies in the fact that the switch circuit is of the "discharge lamp voltage in-phase" type. By providing a switch circuit of the "discharge lamp voltage in-phase type", the ends of the discharge lamp are shorted by the turning on of the switch circuit when the current in the inductance is reduced to zero at the end of the discharge, and therefore all the energy stored in the inductance in advance is utilized effectively, thereby remarkably improving the circuit efficiency. Further, in view of the fact that the switch circuit is turned off only when the current flowing in the switch circuit reaches a predetermined value, the lamp output is maintained constant against changes in parameters, such as changes in source voltage that have so far posed a problem.

DESCRIPTION OF THE PREFERRED EMBODIMENTS

The present invention will be described below in detail with reference to the accompanying drawings.

Figure 1:
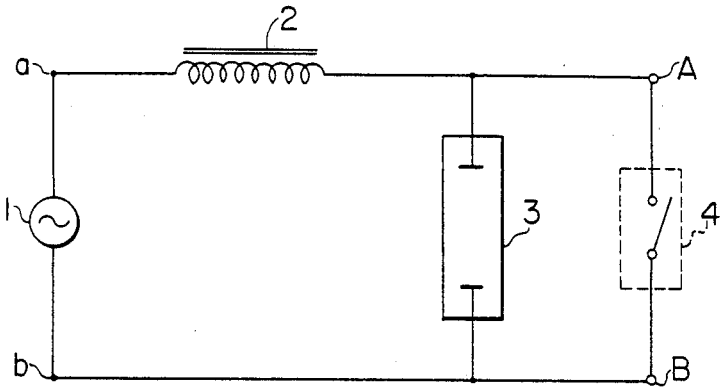
FIG. 1 PRIOR ART
FIG. 1 is a circuit diagram showing a fundamental configuration of a conventional discharge lamp lighting device.
Figure 2:
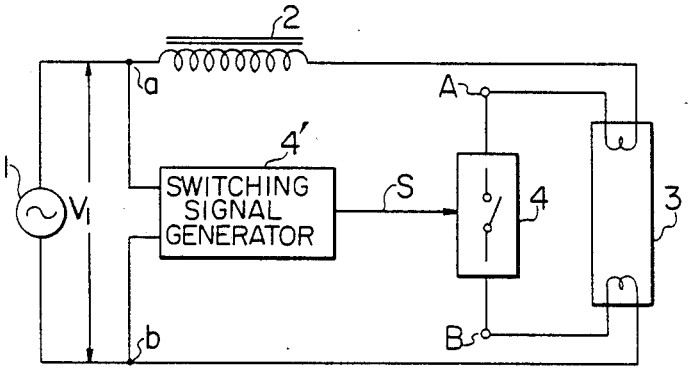
FIG. 2 PRIOR ART
FIG. 2 is a circuit diagram for explaining the operation control of the switch circuit included in a conventional discharge lamp lighting device.
Figure 3:
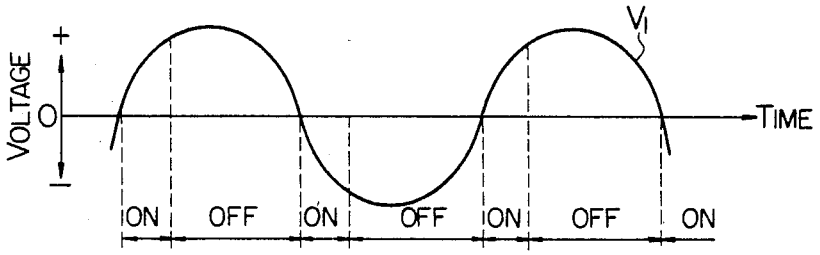
FIG. 3 PRIOR ART
FIG. 3 is a diagram for explaining the operation timing of a switch circuit included in a conventional discharge lamp lighting device.
Figure 4:
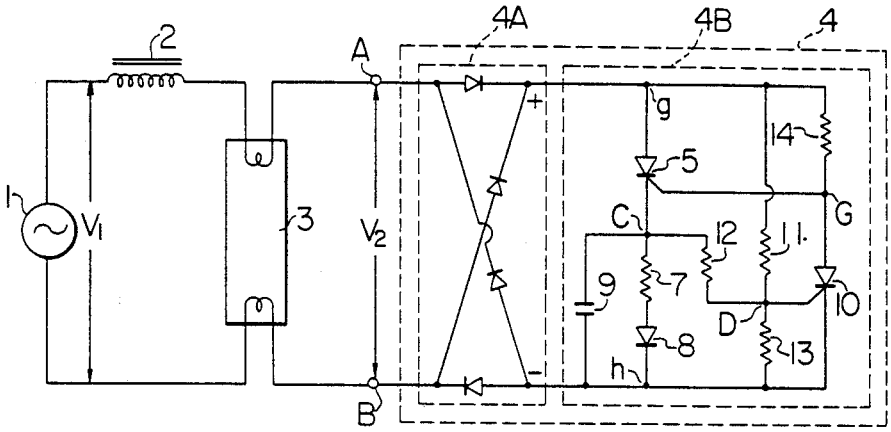
FIG. 4 is a circuit diagram showing a fundamental configuration of a discharge lamp lighting device according to an embodiment of the present invention.

The basic circuit of a discharge lamp lighting device according to an embodiment of the present invention is shown in FIG. 4. In this drawing, reference numeral 1 shows an AC power supply (such as a commercial AC power supply of 100 V), numeral 2 a ballast or stabilizer including an inductance, numeral 3 a discharge lamp (such as a 40 W fluorescent lamp), and numeral 4 a switch circuit. The discharge lamp lighting device according to the present invention is the same as the conventional circuit shown in FIG. 1 in that the AC power supply 1, the ballast 2 including the inductance and the discharge lamp 3 are connected in series with each other, and the switch circuit 4 is connected in parallel to the discharge lamp 3.

Figure 5:
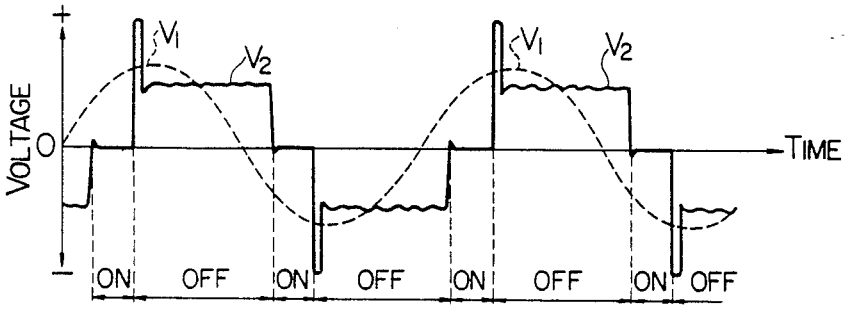
FIG. 5 is a diagram for explaining the operation timing of a switch circuit included in the embodiment of FIG. 4.

The most important feature of the present invention resides in the circuit configuration of the switch circuit 4 connected between the terminals of the discharge lamp 3. Specifically, the switch circuit 4 of the device according to the invention includes a full-wave rectifier 4A and a unidirectional switch circuit 4B connected between the output terminals of the rectifier 4A. The switch circuit 4B, in turn, includes a unidirectional semiconductor switch 5 with control electrode capable of being turned off by a gate signal, which signal 5 is inserted between the output terminals of the full-wave rectifier 4A, and a switching operation control circuit for operating the switch 5 at a predetermined timing. This switching operation control circuit is so constructed that it is turned on immediately after the voltage $V_2$ across the discharge lamp 3 is reduced to zero, and then turned off at a point in time when the current flowing in the switching element 5 reaches a predetermined value as shown in FIG. 5. The full-wave rectifier 4A is for operating the unidirectional switch circuit 4B as an AC switch (bidirectional switch) and for this purpose generally uses a diode bridge circuit.

A specific configuration and the operation of the switch circuit 4B in the embodiment of FIG. 4 will be explained. A unidirectional semiconductor switching element capable of turning off the current flowing therein in response to a reverse trigger signal applied to the control electrode thereof, such as a thyristor having a gate turn-off (GTO) characteristic is used as the switching element 5. The anode terminal of this GTO thyristor 5 is connected to the positive output terminal g of the full-wave rectifier 4A, while the cathode terminal c thereof is connected to the negative output terminal h of the full-wave rectifier 4A through a series circuit including a resistor 7 and a diode 8, which is connected in parallel to a capacitor 9. The gate terminal G of the thyristor 5 is connected to the negative output terminal h of the full-wave rectifier 4A via an ordinary thyristor 10 (having no GTO characteristic). Resistors 11, 12 and 13 make up a firing circuit for the thyristor 10, and a resistor 14 makes up a firing circuit for the thyristor 5.

In the circuit of this configuration, assume that the thyristor 5 is not conducting while the thyristor 10 is conducting. Although the conduction of the thyristor 10 causes current to flow in the resistor 14, the potential of the gate terminal G of the thyristor 5 never exceeds the potential of the cathode terminal C because of the conductive state of the thyristor 10, and therefore the thyristor 5 is never fired. In this case, the conduction of the thyristor 10 is maintained by a small current flowing in the resistor 11, so that the switch circuit 4 is substantially kept off.

When the voltage $V_2$ applied between the terminals A and B of the discharge lamp 3 is reduced to zero, the current flowing in the resistor 11 is also reduced to zero, thus turning off the thyristor 10. If even a slight amount of voltage is applied between the terminals A and B immediately after the turning off of the thyristor 10, the thyristor 5 is immediately fired in view of the fact that the thyristor 5 is open between the gate and cathode (between G and C) and therefore the thyristor 10 is kept off. In other words, as shown in FIG. 5, the thyristor 5 is fired at a time point when the voltage $V_2$ across the discharge lamp is substantially reduced to zero. As a result, the switch circuit 4 is turned on.

By the firing of the thyristor 5, the voltage $V_2$ between the terminals A and B is reduced sufficiently, and therefore the thyristor 10 cannot yet be fired. With the subsequent gradual increase in the current flowing in the ballast 2, the current flowing in the thyristor 5 reaches a predetermined level (namely, the voltage across the resistor 7 reaches a predetermined level), so that thyristor 10 is fired by the current flowing in the resistor 12. Since the charges stored in the capacitor 9 cannot discharge rapidly, the cathode potential of the thyristor 5 (potential at terminal C) exceeds that of the gate terminal thereof (potential at terminal G) (that is, a reversely biased condition occurs), and the thyristor 5 is turned off quickly. As a result, the switch circuit 4 is substantially turned off as shown in FIG. 5. The very small current which continues to flow through the resistors 11 and 14 even after the stoppage of conduction of the thyristor 5 is of course negligible as compared with the current flowing in the conducting thyristor 5.

The rapid turning off of the thyristor 5 causes the current in the ballast 2 (inductance) to be rapidly cut off, thus inducing a high kick voltage across the ballast 2. This kick voltage is superimposed on the source voltage $V_1$ and applied to the discharge lamp, thus starting or restarting the discharge lamp. After that, the energy stored in the ballast 2 is superimposed on the source voltage $V_1$ and applied to the discharge lamp 3 thereby to keep the discharge lamp 3 on. When the discharge lamp 3 is lighted, a very small current flows through the resistors 11 and 13 by generation of the discharge voltage $V_L$ between terminals A and B, so that this particular current, in place of the current that has thus far flowed in the resistor 12, maintains the conduction of the thyristor 10. The thyristor 10 thus is kept on until the voltage $V_2$ across the discharge lamp 3 is reduced again to zero, so that the thyristor 5 is kept off, thus keeping the switch circuit 4 also off.

This process of operation is repeated every half cycle of the voltage $V_2$ across the discharge lamp 3, and the discharge lamp 3 is reignited every half cycle, thus maintaining the lighted state thereof.

As mentioned above, the switch circuit 4 according to the present invention features the operation of what is called the "discharge lamp voltage in-phase" type in which it is turned on at the point in time when or immediately after the voltage across the discharge lamp is reduced to zero and it is turned off when the current flowing in the switch reaches a predetermined value. Therefore, the disadvantage of the prior art lighting device that the terminals A and B of the discharge lamp are shorted by the switch circuit when the discharge lamp is still on and energy still remains in the ballast is eliminated, thus increasing the light output accordingly for a remarkably increased circuit efficiency. Also, in view of the fact that the switch circuit 4 is turned off at the point in time when the current in the switch depending directly on the discharge lamp voltage reaches a predetermined value, the operation timing of the switch against the discharge lamp voltage does not change very much in the face of a change in the source voltage or source frequency, thus greatly reducing the variation in the lamp output.

Figure 6:
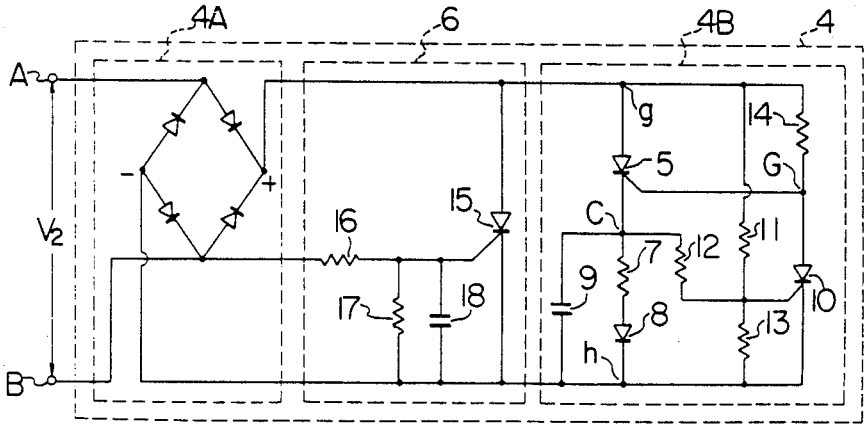
FIG. 6 is a diagram showing an example of configuration of the switch circuit included in the discharge lamp lighting device according to the present invention.

FIG. 6 shows another example of the specific configuration of the switch circuit included in the above-mentioned embodiment of the present invention. In this switch circuit, an electrode preheating circuit 6 is additionally provided in the switch circuit 4 included in the fundamental circuit configuration of FIG. 4. This electrode preheating circuit 6 includes an ordinary thyristor 15 in parallel to the thyristor 5 (between the output terminals g and h of the full-wave rectifier 4A), and resistors 16, 17 and a capacitor 18 making up a firing circuit for the thyristor 15.

In the switch circuit configuration shown in FIG. 4, the current flowing in the switch 4 is maintained always constant regardless of whether the discharge lamp 3 is lighted or not. Therefore, the electrode heating current for starting is not sufficient in the case of a discharge lamp of the preheating type.

By contrast, the switch circuit configuration shown in FIG. 6 is such that in the event that the discharge lamp 3 cannot be started even by the kick voltage generated at the time of turning off of the thyristor 5, the thyristor 15 of the electrode preheating circuit 6 is fired immediately after the turning off of the thyristor 5, thus providing a sufficient amount of the electrode preheating current. Specifically, the surge voltage (kick voltage) generated at the inductance of the ballast upon turning off of the thyristor 5 is not very high as it is absorbed by the discharge current when the discharge lamp 3 is on, while it takes a very great value when the discharge lamp 3 is off since such a voltage is not absorbed by the discharge current. As shown in FIG. 6, the surge voltage between the terminals A and B is integrated by an integrator circuit including the resistors 16, 17 and the capacitor 18 and the output produced from the integrator circuit is used for firing control of the thyristor 15. As a result, in view of the fact that the surge voltage is high and therefore the output of the integrator circuit is high when the discharge lamp 3 is not lighted, the thyristor 15 is fired in place of the thyristor 5 after the turning off of the latter, thus supplying a sufficient amount of electrode preheating current. When the discharge lamp 3 is on, the surge voltage and therefore the output of the integrator circuit is of course reduced to low level, thus preventing the thyristor 15 from being fired.

Figure 7:
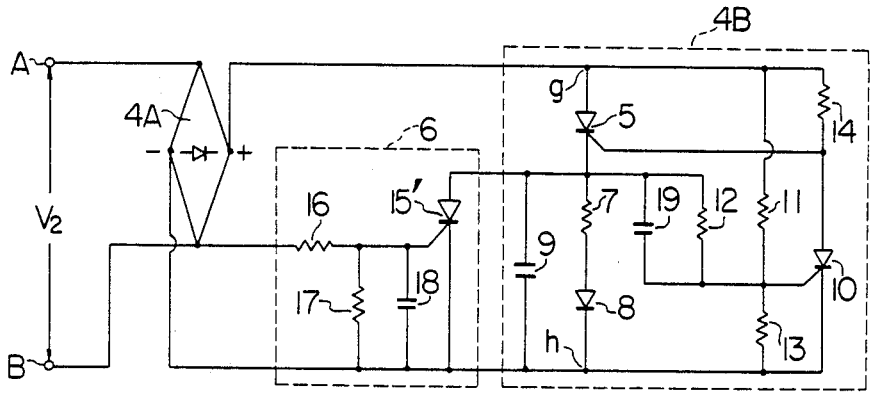
FIG. 7 is a diagram showing another example of the configuration of the switch circuit included in the discharge lamp lighting device according to the present invention.

FIG. 7 shows still another example of the configuration of the switch circuit according to the embodiment under consideration. This circuit is partly improved over the circuit configuration shown in FIG. 6. In the circuit configuration of FIG. 6, the maximum voltage applied to the thyristor 15 is the peak value of the surge voltage, and therefore, a thyristor 15 with a sufficiently high breakdown voltage is required. In the circuit of FIG. 7, on the other hand, the thyristor 15' instead of the thyristor 15 is connected in parallel with a series circuit including the resistor 7 and the diode 8, thus making it possible to use a thyristor with a lower breakdown voltage. In this case, however, the thyristor 5 is not conducting at the firing phase of the thyristor 15', and therefore the mere firing of the thyristor 15' does not short the terminals A and B, so that no electrode preheating current flows. The capacitor 19 is provided for the purpose of firing the thyristor 5 again upon the firing of the thyristor 15'. The capacitor 19 is charged when the thyristor 5 is conducting while the thyristor 15' is turned off. When the thyristor 10 is fired and the thyristor 5 is turned off so that the thyristor 15' is fired by the off-state of the discharge lamp 3, the charge voltage of the capacitor 19 applies a reverse voltage between the gate and the cathode of the thyristor 10 through the thyristor 15' and the thyristor 10 is quickly turned off, thus firing the thyristor 5 again. In the meantime, the charge voltage of the capacitor 18 maintains the conduction of the thyristor 15', with the result that a sufficient amount of electrode preheating current is supplied through the thyristor 5 and the thyristor 15'.

The above-mentioned switch circuit configuration according to the present invention provides a highly efficient discharge lamp lighting device obviating all the problem points of the prior art discharge lamp lighting devices. Also, since the present invention uses a thyristor as a unidirectional semiconductor switching element, the conduction thereof is maintained by itself simply by applying a predetermined trigger current at the time of firing the same, so that the power loss for the whole circuit is low, thereby contributing to power saving.

If the inductance of the ballast 2 is constant in the basic circuit configuration of the discharge lamp lighting device according to the present invention shown in FIG. 4, the light output of the discharge lamp 3 is determined exclusively by the magnitude of the cut-off current $I_{cut}$ for the turning off of the thyristor 5. In turning off the thyristor 5, the current flowing in the cathode impedance of the resistor 7 and the capacitor 9 connected to the cathode terminal C of the thyristor 5 is used to turn off the thyristor 10 at the point in time when the voltage at the terminal C reaches a predetermined value, and a reverse bias is applied between the gate and cathode of the thyristor 5 by the charge voltage of the capacitor 9. With the thyristor 5 turned on, the voltage at terminal C is increased almost linearly if the capacitance of the capacitor 9 is small, and after the turning on of the thyristor 10, the voltage at terminal C is rapidly reduced to zero. It is apparent that the light output or the output power of the discharge lamp 3 becomes larger as the cut-off current $I_{cut}$ of the thyristor 5 increases.

In a discharge lamp lighting circuit, the input power is generally required to be increased and to dampen the output variation due to the source voltage. It is also preferable to reduce the cut-off current $I_{cut}$ thereby to minimize the size of the ballast 2. If the inductance of the ballast 2 is reduced, the power factor with a constant output is increased and the cut-off current is also reduced desirably. In this case, however, the variation in the source voltage causes a great output variation of the discharge lamp undesirably. The gate trigger impedance of the thyristor 10 in the embodiment of FIG. 4 is provided by the resistor 12, and therefore when the capacitance of the capacitor 9 is low, the cut-off current $I_{cut}$ is constant regardless of the variation in the source voltage.

Figure 8:
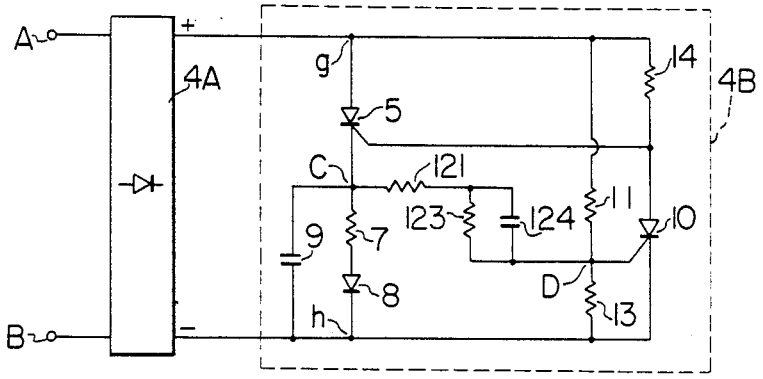
FIG. 8 is a circuit diagram showing a configuration of the switch circuit of the discharge lamp lighting device according to another embodiment of the present invention.

The embodiment of the switch circuit shown in FIG. 8 concerns an improvement made to minimize the output variation caused by the variation in the source voltage. In the embodiment of FIG. 8, the circuit is so configured that the higher the source voltage, the smaller the cut-off current $I_{cut}$, this reducing the degree of increase in the output power of the discharge lamp. By doing so, the general standard requirements concerning the variation in the output of the discharge lamp are satisfied while at the same time reducing the size and weight of the ballast and improving the input power factor. Further, the cut-off current is reduced, thereby reducing the loss of the switch circuit.

Figure 10:
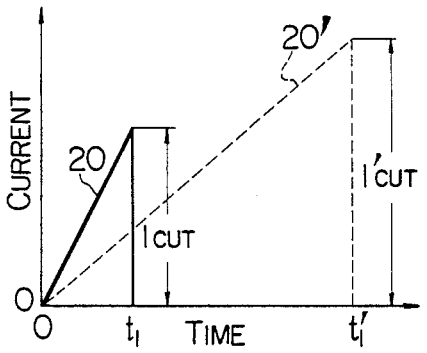
FIG. 10 is a diagram for explaining the operation of the switch circuit of FIG. 8.

In the embodiment of FIG. 8, an impedance circuit including resistors 121, 123 and a capacitor 124 is inserted between terminals C and D in place of the resistor 12 of FIG. 4 as a gate trigger impedance for the thyristor 10. The inclination of current flowing in the cathode of the thyristor 5 which increases linearly along a curve becomes sharper as the voltage of the power supply 1 becomes high. This results in a higher rate of increase in the voltage across the cathode impedance circuit of the thyristor 5 including the resistor 7 and the capacitor 9. In the case where an impedance circuit including the capacitor 124 is used as a gate trigger impedance for the thyristor 10 as shown in FIG. 8, the trigger current for the thyristor 10 increases with the increase in the rate of increase of the voltage across the cathode impedance. Therefore, the thyristor 10 is turned on in response to a lower voltage across the cathode impedance, so that the cut-off current $I_{cut}$ for the thyristor 5 is reduced to a lower level as the voltage $V_1$ of the power supply 1 becomes higher as shown in FIG. 10. (In FIG. 10, the straight line 20 shows the current $I_{cut}$ for a high source voltage $V_1$, and the straight line 20' the current $I_{cut}$ for a lower source voltage $V_1$.)

Figure 11:
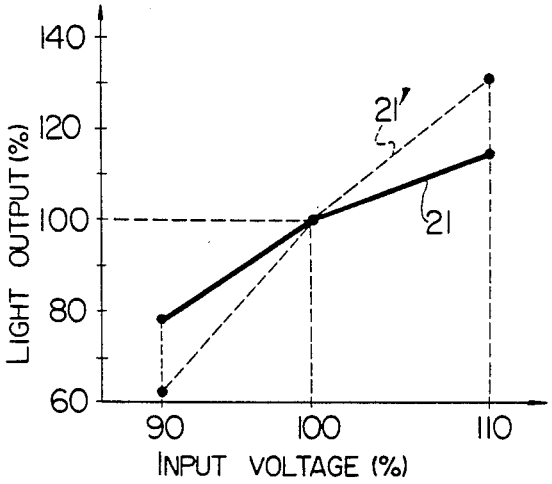
FIG. 11 is a diagram showing an example of the light output variation characteristic of a discharge lamp in the case where the switch circuit shown in FIG. 8 is used.

An example of the variation characteristic of the light output in the case mentioned above is shown in FIG. 11. As seen, in the case where the resistor 12 is used as a gate trigger impedance as shown in FIG. 4, the light output of the discharge lamp undergoes a considerable change along the curve 21' in response to the variation of the input voltage. In contrast, when a circuit including the capacitor 124 is used as shown in FIG. 8 as a gate trigger impedance, the change in the discharge lamp light output is reduced by a very small amount against the variation of the input voltage as shown by the curve 21. This also applies to the case where the circuit including the resistor 123, the capacitor 124 and the diode 125 is used as a gate trigger impedance as shown in FIG. 9.

As an actual example, the circuit of FIG. 8 including the capacitor 124 of 0.1 μF, the resistor 121 of 2.2 KΩ and the resistor 123 of 68 KΩ improves the light output by 15% or more for the source voltage of 90% as compared with the circuit of FIG. 4. In this case, the voltage of the power supply 1 is AC 100 V, the inductance of the ballast 2 is 0.3H, and a 40 W fluorescent lamp is used as the discharge lamp 3. Also, the cut-off current $I_{cut}$ for a 100% source voltage is about 0.4 A; 0.46 A for a 90% source voltage; and 0.34 A for a 110% source voltage. In contrast, if only the resistor 12 is used as the gate trigger impedance as shown in FIG. 4, the cut-off current $I_{cut}$ undergoes no change but remains constant at 0.4 A against the 90% to 110% variation of the source voltage.

Figure 9:
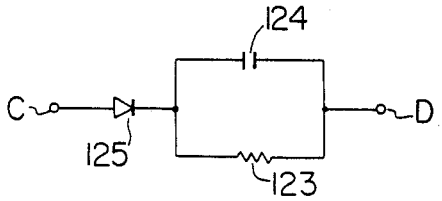
FIG. 9 is a circuit diagram showing an example of the modification of part of the switch circuit shown in FIG. 8.
Figure 12:
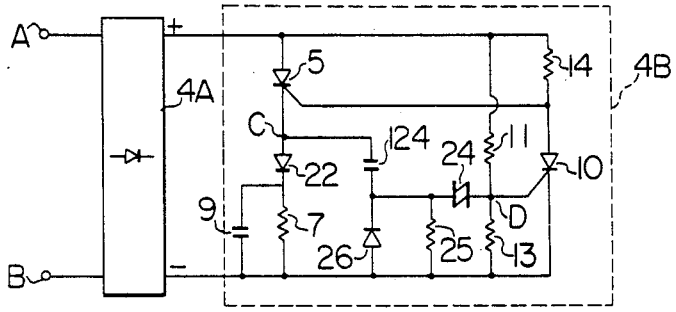
FIG. 12 is a circuit diagram showing another example of the configuration of the switch circuit included in the discharge lamp lighting device according to the present invention.
Figure 13:
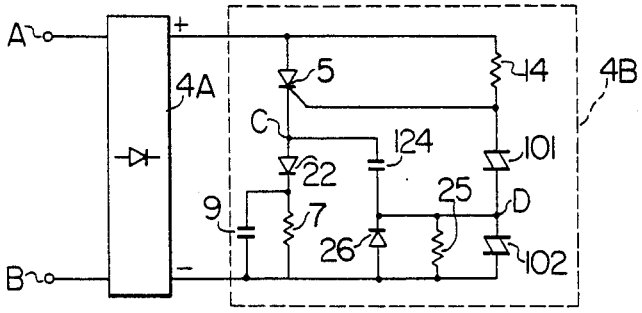
FIG. 13 is a circuit diagram showing still another example of the configuration of the switch circuit included in the discharge lamp lighting device according to the present invention.

The purpose of the resistor 121 and the diode 125 included in the gate impedance circuit of FIGS. 8 and 9 is to prevent the thyristor 5 from being turned on again, which otherwise might occur by the application of the charge voltage of the capacitor 124 in the reverse direction between the gate and cathode of the thyristor 10 and the turning off again of the thyristor 10 in response to the reduction in the voltage at terminal C after the turning off of the thyristor 5. If a long discharge time constant is adopted for the capacitor 124 in the circuit of FIG. 9, the output variation with respect to the source voltage is reduced on the one hand and the vibration of double period which otherwise might be caused by the difference in the cut-off current value of the thyristor at intervals of half cycle is eliminated on the other hand. FIGS. 12 and 13 show other improved embodiments of the present invention based on the same principle. In the circuit configuration of FIG. 4 in which the gate sensitivity of the thyristor 10 changes greatly with the temperature, the cut-off current $I_{cut}$ changes greatly with the temperature, resulting in a great output variation. In FIGS. 12 and 13, by contrast, the breakover voltage of the trigger elements 24, 101 and 102 does not substantially change with the temperature, thus reducing the output change with the temperature.

The embodiment shown in FIG. 12 is such that the trigger element 24 such as an SBS is inserted at the gate of the thyristor 10. In the circuit of FIG. 13, on the other hand, two trigger elements 101 and 102 also in the form of an SBS take the place of the tyristor 10 in FIG. 4. Also in the circuits of FIG. 12 and 13, the gate trigger impedance shown in FIGS. 8 and 9 may be used between terminals C and D with the constants thereof changed. The diode 22 is for preventing an excessive voltage from being applied between the gate and cathode of the thyristor 5, and the terminal C in FIGS. 8 and 9 may represent either an anode or a cathode terminal of the diode 22.

In the circuit of FIG. 12, the resistor 123 parallel to the capacitor 124 is removed and the diode 125 is changed in position by being replaced by the diode 26. The capacitor 124 and the resistor 25 make up a differentiator circuit, the output voltage of which is applied to the trigger element 24. In FIG. 13, when the voltage across the trigger element 102 reaches the breakover voltage $V_{B2}$ thereof, the trigger element 102 is turned on, whereby all the voltage of the cathode impedance is applied to the trigger element 101. Thus the trigger element 101 is turned on at the next moment, thus turning off the thyristor 5. Let the breakover voltage of the trigger element 101 be $V_{B1}$ and the voltage across the cathode impedance be $V_K$, and the variation in output power due to the change in the source voltage is reduced within the range satisfying the relation shown below.

$$V_{B1}, V_{B2} < V_K < V_{B1} + V_{B2}$$

This is also the case if the terminal C of the capacitor 124 is connected to the cathode of the diode 22 in FIGS. 12 and 13. In the absence of the diode 22 such as in the circuit of FIG. 4, a similar trigger circuit may be used with equal effect.

A more preferable embodiment will be described below.

If a large change rate of the cut-off current value is taken with respect to the change in the source voltage, it has been found that the cut-off current value $I_{cut}$ develops a difference every half cycle under a high voltage, thus flickering the light output.

Assume that the capacitance value of the capacitor 124 is determined at such a value that the charge voltage of the capacitor 124 in FIG. 9 substantially sufficiently conducts the thyristor 10 at the rise rate of the conducting current of the thyristor 5 for the upper limit of the source voltage variation range and that the time constant of the resistor 123 and the capacitor 124 is set sufficiently longer than the half cycle time of the power supply. The change voltage once stored in the capacitor 124 discharges only little before the next half cycle when the thyristor 5 is turned on again. Thus, before the refiring of the thyrsitor 5 causes the voltage across the resistor 7 to increase gradually and this voltage reaches the residual voltage of the capacitor 124, no current flows in the diode 125, and when such a voltage reaches the residual voltage of the capacitor 124, a sufficient signal current to turn on the thyristor 10 flows through the capacitor 124, thus firing the thyristor 10. In the case where the specified upper limit of the source voltage is exceeded, the conduction phase of the thyristor 10 no longer depends on the source voltage but it is turned on always at the point in time when the value of the conducting current of the thyristor 5 reaches a predetermined value as in the case of FIG. 4. Below the specified upper limit value of the source voltage, on the other hand, the current supplied from the capacitor 124 is not sufficient to turn on the thyristor 10 but the thyristor 10 can be turned on by addition of the current flowing through the resistors 11 and 123. Therefore, the current in the resistors 11 and 123 changes with the source voltage, so that the cut-off current may be set to change with the source voltage. As a result, even at a very high source voltage, the variation in the output with the source voltage is minimized without developing any error of the cut-off current which otherwise might occur every half cycle.

Assume that the capacitance of the capacitor 124 is made sufficiently large to turn on the thyristor 10 within the entire range of the rise speed of the voltage across the resistor 7 associated with the specified variation range of the source voltage, while at the same time the value of the resistor 123 is rendered sufficiently large or the resistor 123 is replaced with a voltage regulation diode. Upon throwing on the power, the thyristor 5 is turned on, and in spite of the fact that the conducting current is still very small at the rise of the voltage generated across the resistor 7, a sufficient amount of current flows in the capacitor 124 and the thyristor 10 is immediately turned on. In the next half cycle, no current flows through the diode 125 until the voltage across the resistor 7 reaches the residual voltage of the capacitor 124, and when it reaches the residual voltage of the capacitor 124, a current immediately flows in the capacitor 124 thereby to turn on the thyristor 10. In this way, the residual voltage of the capacitor 124 increases with time, thereby increasing the cut-off current of the thyristor 5 accordingly. In steady state, a predetermined cut-off current value depending on the value of the resistors 11 and 13 is reached.

At the time of turning off the thyristor 5, the current in the ballast or inductance 2 is cut off and therefore a pulse voltage or a kick voltage is generated at the ballast 2 upon the cutting off of the thyristor 5. This pulse voltage is important for starting the discharge lamp 3, but application of an excessive pulse voltage will damage the electrodes of the discharge lamp 3. By progressively increasing this pulse voltage (in proportion of the cut-off current) with time, it is always possible to start the discharge lamp 3 at an optimum value of the pulse voltage.

The above-mentioned embodiment of the present invention provides a discharge lamp lighting device in which the output variation due to the change in the source voltage can be dampened to a very small level.

Figure 14:
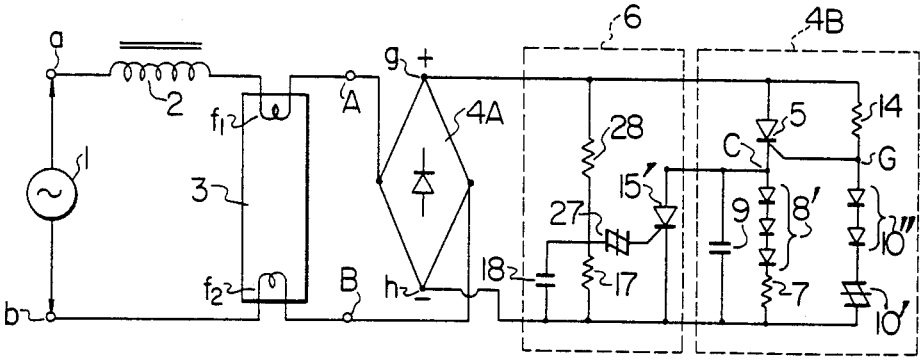
FIG. 14 is a circuit diagram showing a discharge lamp lighting device according still another embodiment of the present invention.

A further embodiment of the present invention is shown in FIG. 14. This embodiment includes an improvement to assure a more proper preheating operation in a discharge lamp lighting device provided with an electrode preheating circuit 6 and designed to supply a sufficient amount of the electrode preheating current for starting the discharge lamp. First, the operation of this circuit at the time of starting the discharge lamp will be explained.

Assume that an auxiliary switching element 10′ is conducting, that the gate turn off thyristor 5 is not conducting and that the discharge lamp 3 is lighted. The discharge voltage of the discharge lamp 3 is produced between the DC output terminals g and h of the full-wave rectifier 4A, and therefore the auxiliary switching element 10′ is maintained in a conducting state by the current flowing in the resistor 14. The number (namely, the forward voltage) of the diodes 8′ and 10″ is determined in such a manner that under this condition the potential difference between terminals G and C (between gate and cathode) of the gate turn off thyristor 5 is substantially zero or the cathode potential at terminal C is slightly higher than the gate potential at terminal G. The difference in number between the diodes 8′ and 10″ (namely, the difference in forward voltage) but not the absolute number thereof is important. Under this condition, the gate turn off thyristor 5 is held in its off state.

When the discharge current of the discharge lamp 3 is reduced substantially to zero and the discharge lamp voltage is reduced sufficiently, the current in the resistor 14 no longer can hold the conductive state of the auxiliary switching element 10′, thus turning off the auxiliary switching element 10′. Upon application of a voltage across the discharge lamp 3, the voltage at terminal G is increased and the current in the resistor 14 flows into the gate of the gate turn off thyristor 5 thus turning on the gate turn off thyristor 5 since the auxiliary switching element 10′ is off. As a result, a closed loop circuit is formed comprising the power supply 1, the ballast 2 including an inductance, the electrode $f_1$, the full-wave rectifier 4A, the gate turn off thyristor 5, the diode 8′, the resistor 7, the full-wave rectifier 4A, the electrode $f_2$ and the power supply 1 in that order, and a current flows in this closed loop. This current causes a voltage drop across the resistor 7, and when the value of this voltage drop reaches the breakover voltage of the auxiliary switching element 10′, the auxiliary switching element 10′ is turned on. The voltage across the resistor 7, namely, the charge voltage of the capacitor 9 is applied between the gate and cathode of the gate turn off thyristor 5 in reverse direction, thus turning off the gate turn off thyristor rapidly according to the gate turn off characteristics thereof. The turning off of the gate turn off thyristor 5 cuts off the current in the ballast 2, so that the kick voltage is generated across the ballast 2 and is applied to the discharge lamp 3 thereby to reignite the discharge lamp 3. This process of operation is repeated every half cycle, thus reigniting the discharge lamp 3 every half cycle.

If this circuit configuration does not include the electrode preheating circuit 6, however, exactly the same operation as that mentioned above is performed at the time of ignition (before ignition) of the discharge lamp 3. Specifically, when the discharge lamp is not lighted, the voltage of the power supply 1, instead of the discharge lamp voltage, is applied between the terminals A and B of the discharge lamp, with the result that at the time of starting the discharge lamp, the conduction period of the gate turn off thyristor is so short that the current flowing in the gate turn off thyristor 5 cannot sufficiently preheat the electrodes $f_1$ and $f_2$ of the discharge lamp 3. In order to supply a sufficient electrode preheating current to the electrodes $f_1$ and $f_2$ at the time of starting the discharge lamp 3, the embodiment under consideration is provided with the electrode preheating circuit 6. In this embodiment, a preheating thyristor 15′ is connected in parallel to the capacitor 9 in the switch circuit 4B, and the operating signal for this preheating thyristor 15′ is generated by making use of the fact that the kick voltage applied across the discharge lamp 3 when the gate turn off thyristor 5 is turned off is different greatly at the times when the discharge lamp 3 is lighted and not lighted. Specifically, the most part of the kick voltage is absorbed into the discharge lamp 3 when the discharge lamp 3 is lighted. Thus, if the resistance value of the resistors 28 and 17 and the capacitance of the capacitor 18 are determined appropriately, it is possible to set the maximum charge voltage of the capacitor 18 to be lower than the breakover voltage of the switching element 27 when the discharge lamp 3 is lighted, and to exceed the breakover voltage at the time of starting the discharge lamp 3. When the discharge lamp 3 is not lighted, however, a high kick voltage is generated so that in spite of the conduction of the preheating thyristor 15′ the auxiliary switching element 10′ still maintains conduction and thus it may be that the gate turn off thyristor 5 will not be turned off, thereby preventing a sufficient amount of electrode preheating current from being supplied. According to the embodiment under consideration, this problem is obviated as described in the following: In order to generate a sufficient voltage to refire the gate turn off thyristor 5 between the terminals G and C of the gate and cathode respectively of the gate turn off thyristor 5 upon turning on of the preheating thyristor 15′, the number of the diodes 10″ is determined in such a manner that the diodes 10″ and the auxiliary switching element 10′ generate the conduction voltage of the preheating thyristor 15′ plus a voltage sufficient to turn on the gate turn off thyristor 5 at the time of conduction of the auxiliary switch 10′.

Immediately after the turning on of the preheating thyristor 15′, therefore, the gate turn off thyristor 5 can be turned on even if the auxiliary switching element 10′ maintains conduction thereof. The result is that a sufficient amount of preheating current flows in a closed loop comprising the power supply 1, the ballast 2 including an inductance, the electrode $f_1$ of the discharge lamp 3, the full-wave rectifier 4A, the gate turn off thyristor 5, the preheating thyristor 15′, the full-wave rectifier 4A, the electrode $f_2$ and the power supply 1 in that order. The number of the diodes 8′ and 10″ is determined of course in such a manner that the gate turn off thyristor 5 is not turned on erroneously when the preheating thyristor 15' is not turned on as already explained.

Figure 15:
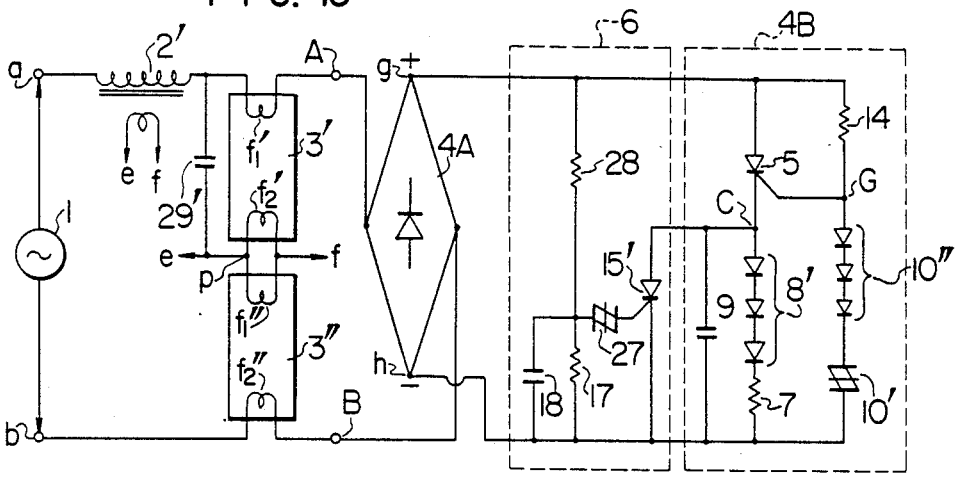
FIG. 15 is a circuit showing a discharge lamp lighting device according to a further embodiment of the present invention.

FIG. 15 shows an example of configuration in which the discharge lamps 3' and 3'' are lighted in series by use of a switch circuit similar to that used in FIG. 14. In this case, a sufficient amount of preheating current is supplied to the electrodes $f_1'$ and $f_2''$ by the electrode preheating circuit 6, while the electrodes $f_2'$ and $f_1''$ are supplied with the preheating current from the preheating winding of the ballast 2' as required. The capacitor 29' is an auxiliary one generally used for lighting the two discharge lamps in series.

The discharge lamp lighting circuit according to the present invention is more effective the smaller the difference between the discharge voltage and the source voltage. For this reason, it is sometimes difficult to accurately detect whether or not the discharge lamp 3 is lighted, only by reference to the difference in magnitude of the kick voltage applied to the discharge lamp.

In the case where the discharge lamp load comprises two lamps in series as shown in FIG. 15, the resistor 28 may be connected not to the DC output terminal g of the full-wave rectifier 4A but to the terminal p common to the series-connected discharge lamps 3' and 3''. In this way, the potential at the terminal p is substantially equal to the potential developed at the DC output terminal g through the capacitor 29' (that is, the potential almost equal to the total voltage applied to the two discharge lamps) when the discharge lamps 3' and 3'' are not lighted; while it is half the potential of the total voltage of the discharge lamps, that is the potential equal to the discharge lamp voltage of one discharge lamp 3'' when the discharge lamps 3' and 3'' are lighted. As a result, it is possible to take a sufficient difference of the detection voltage through the resistor 28.

Figure 16:
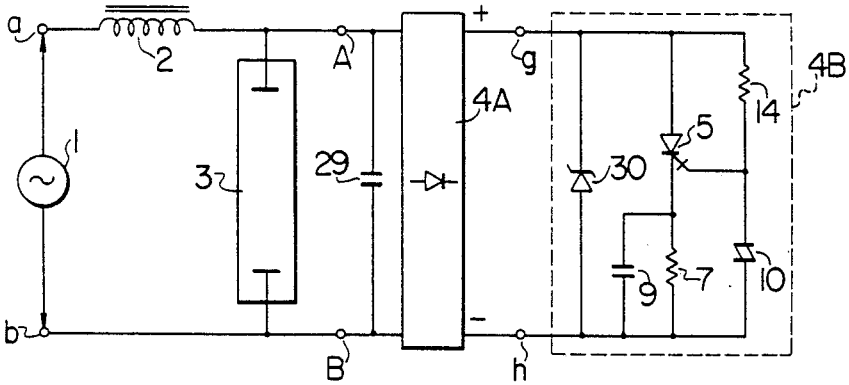
FIG. 16 is a circuit showing a discharge lamp lighting device according to a still further embodiment of the present invention.

FIG. 16 shows a still further embodiment of the present invention. The discharge lamp lighting circuit according to this embodiment comprises a power supply 1, ballast 2 including an inductance, and a discharge lamp 3 connected to each other, a noise-reducing capacitor 29 and a switch circuit 4B connected across the discharge lamp 3 through a full-wave rectifier 4A. The switch circuit 4B includes a switching element 5 connected between the DC output terminals g and h of the full-wave rectifier 4A and an operation control circuit for the switching element 5. The switching element 5 is provided by a thyristor having a GTO characteristic.

When the voltage produced between the DC output terminals g and h of the full-wave rectifier 4A reaches a predetermined level every half cycle, the switching element 5 is turned on by the trigger current supplied through the resistor 14, thus supplying the current to the ballast 2. The voltage generated at the cathode resistor 7 and the capacitor 9 when this current reaches a predetermined level turns on the switching element 10 such as an SBS, so that a reverse trigger current is applied to the control electrode or gate of the switching element 5. The switching element 5 is thus rapidly turned off, and the current flowing in the ballast 2 is cut off quickly. A high voltage pulse (kick voltage) is generated at the ballast 2 and applied to the discharge lamp 3, so that the discharge lamp 3 is started and the electromagnetic energy stored in the ballast 2 is superimposed on the input from the power supply 1, which energy is supplied to the discharge lamp 3, thus maintaining the lighted state thereof. When the polarity of the source voltage is reversed and the discharge lamp voltage is reduced to zero, the voltage between terminals g and h is also reduced to zero, and therefore the switching element 10 that has so far been held on by the discharge lamp voltage of the discharge lamp 3 is turned off, restoring the original condition. The switch circuit 4B repeats this process of operation, thus reigniting the discharge lamp 3 every half cycle on the one hand and maintaining the lighted condition thereof on the other hand.

In this discharge lamp lighting circuit, the on-off operation of the switch circuit 4B causes the energy stored in the ballast 2 to be supplied efficiently into the discharge lamp 3. In the case of a 40 W fluorescent lamp, for example, the pulse voltage generated at the time of turning off the switch is preferably about 1000 V.

In this case, the pulse voltage available depends on the breakdown voltage of the switching element 5, and in order to protect the switching element 5 from an excessive pulse voltage, a voltage regulation element such as a controlled avalanche rectifier diode 30 is connected to the switch circuit 4B.

In the event that a voltage of several hundred to several thousand volts is applied to the switching element 5, it is preferably not burdened by a single switching element with a large breakdown voltage but by a plurality of series-connected switching elements low in the breakdown voltage sharing the applied voltage. This is desirable both from the viewpoint of characteristics and economy.

A voltage sharing system is well known in which a plurality of ordinary thyristors each of which has no turn-off ability are connected in series to each other, and each of the thyristors is connected with a resistor R, a capacitor C or a constant voltage element in parallel. In the case where the current flowing in the inductance is cut off by the turn-off operation of each element to generate a high voltage pulse, however, the irregularity of turn-off time among the series-connected elements causes a single element to be burdened with the entire voltage disadvantageously.

Figure 17:
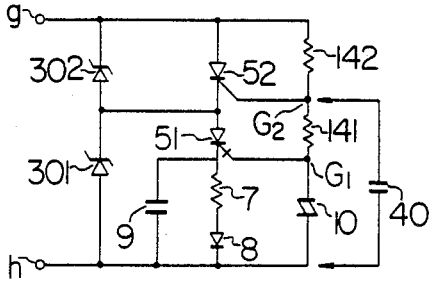
FIG. 17 is a circuit diagram showing another example of the switch circuit included in the discharge lamp lighting device shown in FIG. 16.
Figure 18:
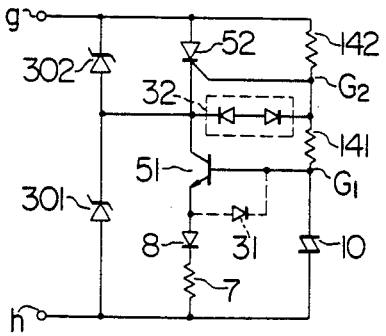
FIG. 18 is a circuit diagram showing still another example of the configuration of the switch circuit included in the discharge lamp lighting device shown in FIG. 16.

FIGS. 17 and 18 show embodiments of the switch circuit improved to obviate this problem. A plurality of switching elements with a control electrode including at least one switching element capable of being turned off in response to a reverse trigger voltage applied to the control electrode thereof are connected in series to each other, and the control electrodes of these switching elements are connected to corresponding junction points of series-connected trigger resistors, thereby making up a switch circuit. Also, the switch circuit is connected in parallel with a capacitor, so that the switching elements with a control electrode are turned off sequentially in such a manner that the voltage burdened by each of the switching elements with control electrode does not exceed the breakdown voltage thereof. The capacitor to be connected in parallel to the switch circuit may either double as the noise-reducing capacitor 29 in FIG. 16 or may be separately inserted between the terminals g and h.

As seen from above, the switch circuit 4B shown in FIG. 17 is an example in which a thyristor having the gate turn off characteristic is used as the switching element 51 with control electrode capable of being turned off in response to a trigger signal applied to the control electrode thereof in reverse polarity, and an ordinary thyristor is used as the other switching element 52 with control electrode. Even in the ordinary thyristor, it is possible to turn it off by applying a reverse trigger current in the case of a very small conduction current involved. This characteristic is effectively utilized in this embodiment. The switching elements 51 and 52 are connected in series between the terminals g and h, and their control electrodes are connected respectively to the junction points $G_1$ and $G_2$ of the resistors 141 and 142 connected in series. The cathode of the switching element 51 is connected to the resistor 7, the capacitor 9 and the diode 8, while the control electrode (gate) thereof is connected to the switching element 10 such as an SBS adapted to be turned on in response to a predetermined voltage. The switching elements 51 and 52 are respectively connected in parallel to the voltage regulation elements (avalanche diodes) 301 and 302 for protection from an over-voltage. The avalanche voltage of these voltage regulation elements is determined to be lower than the breakdown voltage between the anode and cathode of the corresponding switching elements 51 and 52 respectively. The trigger resistor 141 is set at a value sufficiently lower than the value of the resistor 142.

Now, explanation will be made of the operation of a discharge lamp lighting circuit using this switch circuit in place of the switch circuit 4B shown in FIG. 16. When the voltage between the terminals g and h reaches a predetermined value after completion of discharge of the discharge lamp 3, the switching elements 51 and 52 are turned on by the trigger current supplied from the trigger resistors 141 and 142, thereby supplying a gradually ascending current to the ballast 2 via the full-wave rectifier 4A. When this current increases so that the charge voltage of the capacitor 9 reaches a predetermined value, the switching element 10 is turned on and a reverse trigger current is supplied to the gate of the switching element 51 by the voltage of the capacitor 9, thus turning off the switching element 51. The current that has so far flowed in the ballast 2 transfers to the capacitor 29 doubling as a noise-reducing device thereby to charge the same. Until the time point when this charge voltage reaches the avalanche voltage of the voltage regulation element 301, the anode current flowing into the switching element 52 flows out to the resistor 141 in the form of reverse trigger current, the value of which is limited by the trigger resistor 141. On the other hand, the cathode current of the switching element 52 is reduced to zero, and therefore if the capacitance of the capacitor 29 is determined in such a manner that the charge voltage thereof does not exceed the avalanche voltage of the voltage regulation element 301 (namely, does not exceed the breakdown voltage of the switching element 51) during the time period required for turning off the switching element 52, the switching element 52 is turned off during the particular period. After that, the charge voltage of the capacitor 29 further increases but the voltage applied to the switching elements 51 and 52 does not exceed the voltage determined by the voltage regulation elements 301 and 302 respectively, with the result that the voltage applied to the switching elements 51 and 52 is maintained below the breakdown level of the switching elements. By cutting off the current flowing in the ballast 2 in this manner, a pulse voltage equivalent to the sum of the avalanche voltages of the voltage regulation elements 301 and 302 in maximum is generated between the terminals g and h.

As mentioned above, at the time of turning off of the switching element 52, all the anode current thereof flows out in the form of a trigger current (gate reverse current) with the cathode current zero, and therefore if the turn off gate sensitivity (cut-off anode current divided by the gate reverse current thereof) is not less than 1, it is possible to turn off the switching element 52 normally even if the current capable of being cut off is much smaller than that of the switching element 51. In the case where it is impossible to take a sufficient large capacity of the capacitor 29 for the reason of circuit characteristics, a speed-up capacitor 40 is connected to the gate terminal G of the switching element 52. By doing so, the extraction of the minority carriers from the P base layer of the switching element 52 is promoted, thus shortening the turn-off of the switching element 52.

The switching circuit of FIG. 18 is an example using a transistor as the switching element 51, and the operation thereof is substantially the same as that of the switch circuit of FIG. 17. In the circuit of FIG. 18, the transistor can be turned off only by reducing the base current thereof to zero, thereby eliminating the need of the capacitor 9 on the emitter side thereof. Numeral 31 shows a diode for protecting the switching element (transistor) 51 from the reverse voltage between the emitter and base thereof, and numeral 32 a diode for protection from the reverse voltage between the cathode and gate of the switching element (thyristor) 52. These diodes are inserted in the circuit if required to secure reliability of the switching elements 51 and 52.

Figure 19:
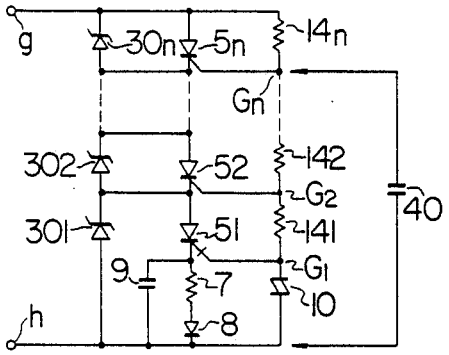
FIG. 19 is a circuit diagram showing a further example of the configuration of the switch circuit included in the discharge lamp lighting device according to the present invention.

FIG. 19 shows an example of the configuration of the switch circuit comprising series-connected switching elements (thyristors) in the number of n each having a control electrode. The switching elements 51, 52, . . . . **5*n* are turned on almost simultaneously by the trigger current supplied from the trigger resistors 141, 142, . . . , 14*n* respectively, and the current flowing in the switching element 51 is cut off by applying a reverse trigger signal to the gate terminal $G_1$ of the switching element 51 after the conduction of the switching element 10. The capacitor 29 connected in parallel to the switch circuit and the trigger resistors 141, 142, . . . . 14*n* functions in such a manner that after the turning off of the switching element 51 before the applied voltage reaches the avalanche voltage of the voltage regulation element 301, the switching element 52 is turned off, followed by the turning off of the switching elements 53 to 5*n*** in that order.

Among the trigger resistors 141, 142, . . . , **14*n*, the resistors 141 to 14$(n-1)$ are set at a sufficiently small value as compared with the resistor 14*n*. In this way, the switching elements 51, 52, . . . , 5*n* are kept off stably. In the case where the capacitance of the capacitor 29 cannot be increased sufficiently the speed-up capacitor 40** is connected to part or all of the gate terminals.

The switching elements 51, 52, . . . , **5*n* may take the form of any unidirectional element with control electrode, and if only one switching element 51 is capable of being turned off with a reverse trigger signal, the other switching elements 52 to 5*n* may have a very small current capable of being cut off, as compared with the switching element 51**.

In the embodiment mentioned above, the voltage is distributed among a plurality of switching elements with control electrode in series by use of a voltage regulation element. As an alternative, the voltage may be distributed among the switching elements without using a voltage regulation element but with the use of a trigger resistor connected to the control electrodes of the switching elements as a balancing resistor.

Figure 20:
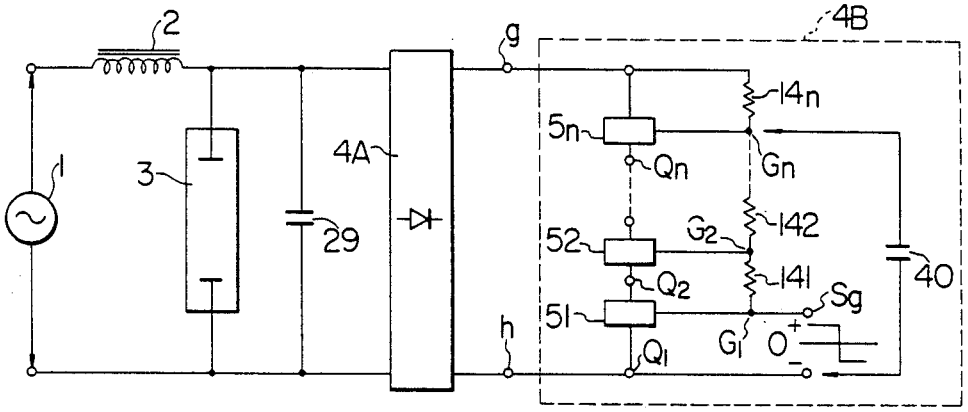
FIG. 20 is a circuit block diagram showing a discharge lamp lighting device according to a still further embodiment of the present invention.

FIG. 20 shows a configuration of the discharge lamp lighting circuit in which the current flowing in the inductance is cut off by the switch circuit using the trigger resistors as a balancing resistor. The power supply 1, the inductance 2 and the discharge lamp 3 are connected in series with each other. In parallel to the discharge lamp 3, the switch circuit 4B is connected through the full-wave rectifier 4A, and the capacitor 29 is connected in parallel to the switch circuit 4B. A plurality of switching elements 51, 52, . . . , 5*n* each having a control electrode are connected in series between the terminals g and h of the switch circuit 4B, and the control electrodes are connected to junction points $G_1$, $G_2$, . . . , $G_n$ of the series-connected trigger resistors 141, 142, . . . , 14*n* respectively. Among the switching elements 51, 52, . . . , 5*n* each having a control electrode, at least one switching element 51 is capable of cutting off the conduction current thereof by being supplied with a reverse trigger signal to the control electrode thereof, while the other switching elements 52 to 5*n*, though small in the current capable of being cut off, can be turned off by being supplied with a very small reverse trigger current to the respective control electrodes thereof. Characters $Q_1$ to $Q_n$ show connection terminals of the switching elements 51 to 5*n* respectively.

Figure 21:
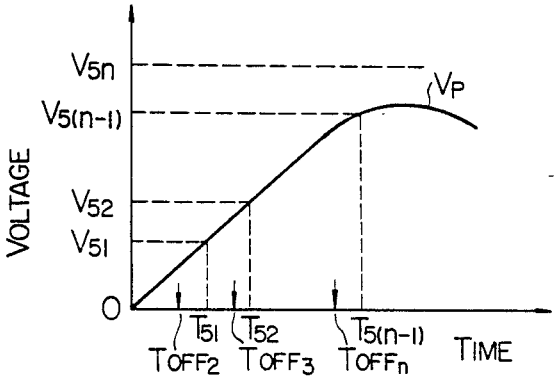
FIG. 21 is a diagram for explaining the operation of the discharge lamp lighting device of FIG. 20.

The operation of the switch circuit 4B will be described with reference to FIG. 21. When the terminal g attains a positive potential, the switching elements 51 to 5*n* are turned on almost at the same time through the trigger resistors 141 to 14*n* respectively. A current flows through the inductance 2, the full-wave rectifier 4A and the switch circuit 4B. When this current reaches a predetermined value, a reverse trigger signal (negative voltage) Sg is applied to the control electrode of the switching element 51 thereby to turn off the same. The current flowing in the inductance 2 transfers to the capacitor 29, thereby increasing the terminal voltage Vp of the capacitor 29 as shown in FIG. 21. This voltage is applied to the trigger resistor 141 so as to take out a reverse trigger current from the control electrode of the switching element 52 for the turning off operation. Under this condition, the current flowing in the terminal $Q_2$ is zero, and therefore all the current flowing into the switching element 52 flows out of the control electrode thereof in the form of a reverse trigger current, so that the turn off gain becomes 1. This current takes a small value limited by the trigger resistor 141, and therefore the switching element 52 is turned off at the time point $T_{off2}$ in FIG. 21. The time required for this turn off operation is determined by the switching characteristics such as storage time or fall time of the switching element 52, the value of the resistor 141 and the rate of increase of the voltage Vp across the capacitor 29. Therefore, the capacitance of the capacitor 29 and the value of the resistor 141 are set in a manner to assure that the turn-off time point $T_{off2}$ is earlier than the time point $T_{51}$ when the voltage Vp of the capacitor 29 reaches the breakdown voltage $V_{51}$ of the switching element 51.

Upon the turning off of the switching element 52, the voltage Vp of the capacitor 29 is applied dividedly to the trigger resistors 141 and 142, and therefore even when the capacitor voltage Vp exceeds $V_{51}$, the voltage burdened by the switching element 51 is equal to the voltage applied to the resistor 141, so that this voltage is maintained below $V_{51}$, which does not exceed the breakdown voltage of the switching element 51. The turn off operation of the switching elements other than the switching element 52 are the same as that of the switching element 52, and the switching elements including the last switching element 5*n* are turned off sequentially. The voltage applied to the switching elements in this process are determined by the dividing ratio of the trigger resistors 141 to 14*n*. This voltage-dividing ratio is determined in such a manner that each voltage division does not exceed the breakdown level of the respective elements. The capacitance of the capacitor 29 and the values of the trigger resistors 141 to 14*n* are determined in such a manner that the turn off time of each switching element satisfies the condition $T_{off\text{-}k} < T_{5(k-1)}$ for all the values of k from 2 to n. In the event that the capacitance of the capacitor 29 cannot be made sufficiently large for the reason of circuit characteristics, a speed-up capacitor 40 is connected to part or all the control electrodes taking into account the voltage distribution among the switching elements.

Figure 22:
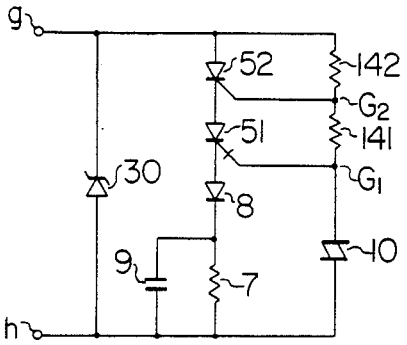
FIG. 22 is a circuit diagram showing a specific example of the configuration of the switch circuit included in the discharge lamp lighting device shown in FIG. 20.
Figure 23:
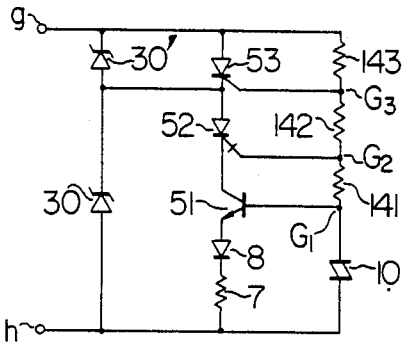
FIG. 23 is a circuit diagram showing another specific example of the configuration of the discharge lamp lighting device shown in FIG. 20.

FIGS. 22 and 23 show specific configurations of the switch circuit of FIg. 20. In the switch circuit of FIG. 22, a thyristor having a gate turn off characteristic is used as the switching element 51 and an ordinary thyristor is used as the switching element 52. The cathode of the switching element 51 is connected with the resistor 7, the capacitor 9 and the diode 8, while the gate thereof is connected with the switching element 10 such as an SBS turned on in response to a predetermined voltage. Numeral 30 shows an avalanche diode for protection from an excessive voltage.

When the voltage between the terminals g and h reaches a predetermined level with the switching element 10 off, the switching elements 51 and 52 are turned on thereby to produce an ascending current. When the voltage across the capacitor 9 increases to a predetermined value, the switching element 10 is turned on, and a reverse trigger current is taken out of the gate of the switching element 51, thus turning off the switching element 51. As a result, a voltage is applied to the trigger resistor 141 and a reverse trigger current is taken out of the gate of the switching element 52, thus turning off the switching element 52. The diode 8 is for increasing the cathode potential of the switching element 51 thereby to prevent the switching element 51 from being turned on again by a pulse voltage generated at the time of current cut off.

The switch circuit of FIG. 23 is an example in which a transistor is used as the switching element 51. In view of the fact that the transistor has a high switching speed, the capacitor 9 is not required. The switching elements 52 and 53 are ordinary thyristors, but their turn off time becomes shorter as the resistance values of the trigger resistors 141 and 142 becomes smaller. Therefore, the resistors 141 and 142 are required to have a sufficiently small value as compared with the resistor 143. For this purpose, it is recommended that a constant-voltage element 30′ be connected between the anode and cathode of the switching element 53 as required. By doing so, after the turning off of the switching elements 51, 52 and 53, part of the current in the voltage regulation element 30′ flows through the gate of the switching element 53 to the trigger resistors 141 and 142, thus maintaining the required voltage dividing ratio.

It will be understood from the foregoing description that according to the above-mentioned embodiments of the present invention there is provided an economical discharge lamp lighting circuit superior in characteristics which is capable of generating a sufficiently high pulse voltage by use of a semiconductor switching element with a low breakdown voltage.

Figure 24:
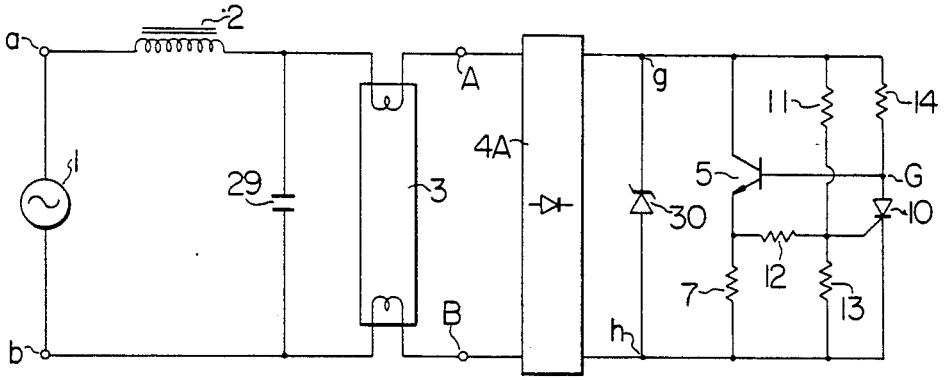
FIG. 24 is a circuit diagram showing a still further embodiment of the discharge lamp lighting device according to the present invention.

A discharge lamp lighting device according to a still further embodiment of the present invention is shown in FIG. 24. This embodiment uses a transistor as the main switching element 5 of the switch circuit. A low-cost discharge lamp lighting device is provided by using a general-purpose transistor such as a bipolar transistor or a MOS.FET as the main switching element 5.

The switching transistor 5 is inserted between the DC output terminals g and h of the full-wave rectifier 4A, and the emitter thereof is connected with a resistor 7. The resistor 14 makes up a base drive circuit for supplying a turn on signal to the base of the switching transistor 5 from the positive output terminal g of the full-wave rectifier 4A. Numeral 10 shows an auxiliary switching element (an ordinary thyristor) for turning off the switching transistor 5, and the anode thereof is connected to the base terminal G of the switching transistor 5 while the cathode thereof is connected to the negative output terminal h of the full-wave rectifier 4A. The resisors 11, 12 and 13 make up a firing circuit for the thyristor 10. Numeral 30 shows a voltage regulation element such as an avalanche diode for protection from an excessive voltage.

The operation of this circuit will be explained. While the discharge lamp 3 is lighted, the current flowing in the resistor 11 holds the thyristor 10 in its on state, and even if the current flows in the resistor 14, the switching transistor 5 is not turned on. At the end of every half cycle of the voltage applied between the terminals A and B of the discharge lamp 3, the discharge lamp current is reduced to zero and so is the voltage between the terminals A and B, so that the current flow in the resistors 14 and 11 is reduced to zero, thus turning off the thyristor 10. When a voltage of a reverse polarity is produced between the terminals A and B, the base current flows into the base of the switching transistor 5 through the resistor 14, thus immediately turning on the switching transistor 5. As a result, the voltage between the terminals A and B is reduced to a sufficiently small level and thus the thyristor 10 is still prevented from being turned on. Upon the turning on of the switching transistor 5, the voltage across the resistor 5 increases with the increase in the current flowing between the terminals A and B, and when this voltage reaches a predetermined level, the thyristor 10 is turned on by the current flowing in the resistor 12. Since the current stops flowing into the base of the switching transistor 5, the switching transistor 5 is rapidly turned off, thus substantially cutting off the current that has thus far flowed between the terminals A and B. In the process, the discharge lamp 3 is lighted by the pulse voltage generated in the inductive ballast 2. Further, the electromagnetic energy stored in the inductive ballast 2 is superimposed on the input from the power supply and applied to the discharge lamp 3, so that stable discharge is assured even if the discharge maintain voltage (lamp voltage) is the same as or slightly lower than the source voltage. The resistor 11 is for holding the thyristor 10 in its on state during the discharging operation of the discharge lamp every half cycle, thereby preventing the switching transistor 5 from being turned on again.

The above-mentioned process of operation is repeated. The transistor 5 which is a main switching element is turned on always immediately after the end of discharge of the discharge lamp and turned off when the conduction current of the switching transistor 5 reaches a predetermined value, thus utilizing effectively the energy stored in the inductive ballast 2.

In order to assure the switching operation, the resistance value of the resistor 14 is preferably sufficiently large as compared with that of the resistor 7 on the one hand and the collector-emitter voltage of the switching transistor 5 is preferably as small as possible when the transistor 5 is on the other hand. For this purpose, the DC amplification factor $h_{FE}$ of the switching transitor 5 is preferably large, and an ideal characteristic is attained by use of a Darlington pair of transistors or MOS.FET. In this device, the energy stored in the inductive ballast 2 is so large that a pulse voltage as high as several thousand volts is generated at the time of turning on of the switching transistor 5. The voltage regulation element 30 is provided for the purpose of protecting the switching transistor 5 from this high pulse voltage.

In the case of amplification factor $h_{FE}$ larger than several hundreds, the breakdown voltage of the transistor may not be sufficient. In this case, two or more transistors in series should be used, or a balance resistor should be connected in parallel to each transistor to distribute the applied voltage among the transistors to assure a voltage for each transistor below the breakdown level thereof. As still another alternative, in the case of MOS.FET, the series connection thereof contributes to a higher breakdown voltage.

Figure 25:
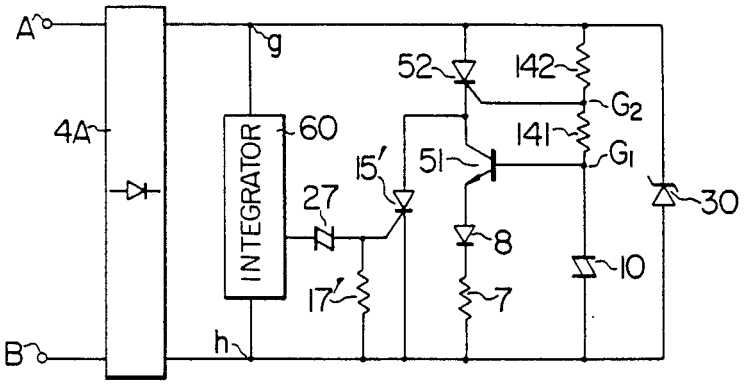
FIG. 25 is a circuit diagram showing another example of the configuration of the switch circuit included in the discharge lamp lighting device shown in FIG. 24.

A still another embodiment in which an electrode preheating circuit is inserted in addition to a transistor functioning as the main switching element will be described with reference to FIG. 25. In FIG. 25, numerals 52 and 15' show three-terminal thyristors. In order to increase the breakdown voltage, the thyristor 52 is connected in series with the switching transistor 51. Alternatively, a Darlington pair of bipolar transistors or MOS.FET may be used. The current capacitor of the switching transistor 51 may be small if the amplification factor $h_{FE}$ is sufficiently high for the current range below the cut-off level thereof.

According to this embodiment, a two-terminal thyristor (SBS) is used as an auxiliary switching element 10 for turning off the switching transistor 51, thus simplifying the circuit configuration further as compared with the switch circuit of FIG. 24. The two-terminal thyristor 10 connected between the base terminal $G_1$ of the switching transistor 51 and the negative output terminal h of the full-wave rectifier 4A is turned on when the voltage across the resistor 7 increases and reaches a predetermined value with the increase in the current flowing in the switching transistor, and is held on by the current in the resistors 141 and 142 while the discharge lamp is discharging every half cycle. The diode 8 is for increasing the emitter potential of the switching transistor 51 and thus preventing the switching transistor 51 from being turned on again by the pulse voltage generated at the time of turning off thereof.

The thyristor 15' is connected in parallel to the switching transistor 51. The integrator circuit 60, the resistor 17 and the switching element 27 such as an SBS adapted to be turned on upon application of a predetermined voltage thereto make up a trigger circuit for the thyristor 15'. In the circuit of FIG. 24, the same current flows between terminals A and B regardless of whether the discharge lamp is lighted or not, and therefore the electrode preheating current may not be sufficient in the case of the discharge lamp of preheating type. The pulse voltage generated in the inductive ballast 2 at the time of turning off of the switching transistor 51 has a large pulse width when the discharge lamp is not lighted, and the pulse width thereof is extremely narrowed by being absorbed into the discharge lamp when the discharge lamp is lighted. In the circuit of FIG. 25, making use of this difference of pulse width, the pulse voltage generated in the inductive ballast 2 is integrated in the integrator circuit 60 only during the off time of the discharge lamp, and the resulting integrated voltage is used to supply a trigger current to the thyristor 15' via the switching element 27 thereby to turn on the thyristor 15', thus supplying a sufficient amount of preheating current to the electrodes of the discharge lamp 3. The anode of the thyristor 15' is connected to the collector of the switching transistor 51, and therefore upon the turning on of the thyristor 15', the thyristor 52 is turned on automatically in response to the forward trigger current from the resistor 142, so that the electrode preheating current continues to be supplied until the thyristors 52 and 15' are turned off when the voltage across the discharge lamp passes the next zero level.

The current cut-off operation of the switching transistor 51 and the thyristor 52 will be described below.

As described above, when the conduction current of the switching transistor 51 reaches a predetermined value, the increase in the voltage across the resistor 7, i.e., the increase in the emitter potential of the switching transistor 51 turns on the two-terminal thyristor 10 and the base current stops flowing in the switching transistor 51, so that the switching transistor 51 is immediately turned off. The current in the inductive ballast 2 is transferred to the noise-reducing capacitor 29 (FIG. 24) connected in parallel to the discharge lamp 3, thus increasing the voltage across the capacitor 29. This voltage is applied to the resistor 141, and the current flowing into the anode of the thyristor 52 flows out to the resistor 141 in the form of a reverse trigger current. Since the cathode current of the thyristor 52 is zero at this time, the thyristor 52 is rapidly turned off by the reverse trigger current. If the values of the capacitor 29 and the resistor 141 are set in such a manner that the thyristor 52 is turned off before the voltage across the capacitor 29 reaches the breakdown voltage of the switching transistor 51, the switching transistor 51 is not broken by the pulse voltage generated by the inductive ballast 2.

According to this embodiment of the present invention, a low-cost transistor easily available is used as the main switching element of the switch circuit, and this simple configuration provides a discharge lamp lighting device high in energy efficiency which is capable of lighting directly the discharge lamp with a discharge maintain voltage approximate to a source voltage by the commercial AC power supply. Further, by combined use of a thyristor and a switching transistor small in voltage and current capacity, a sufficiently high pulse voltage is generated on the one hand and accurate electrode preheating operation is assured on the other hand.

Figure 26:
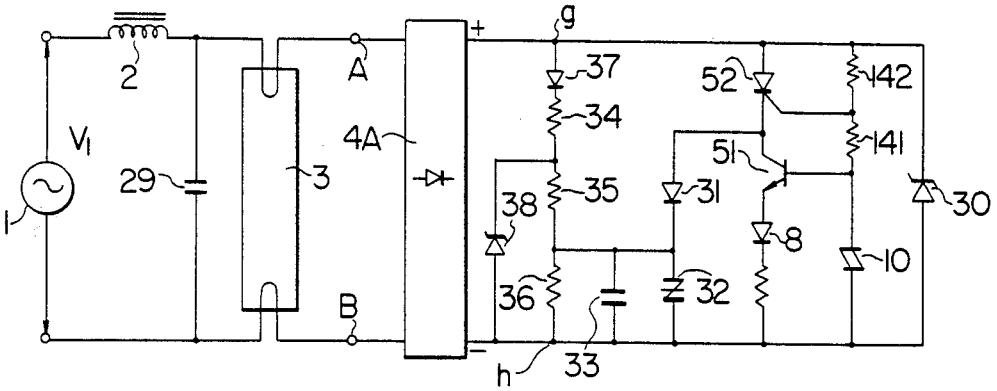
FIG. 26 is a circuit diagram showing a still further embodiment of the discharge lamp lighting device according to the present invention.

A still further embodiment of the present invention is shown in FIG. 26. This embodiment is the result of simplifying further the circuit configuration for supplying the preheating current to the electrode of the discharge lamp for starting the discharge lamp. In the drawing, a thyristor 52, a transistor 51, a diode 8, resistors 7, 142 and 141, a reverse trigger switching element 10 such as an SBS which is turned on in response to a voltage higher than a predetermined value, and an avalanche diode 30 make up a switch circuit for generating a pulse voltage every half cycle and holding the lamp on. The thyristor 52 and the transistor 51 connected in series with each other are connected via the full-wave rectifier 4A between the terminals A and B. The resistor 7 is connected in series to the thyristor 52 and the transistor 51 as a current-detecting impedance element. The resistors 142 and 141 make up a trigger circuit for connecting the positive output terminal g of the full-wave rectifier 4A to the control electrodes of the thyristor 52 and the transistor 51. The reverse trigger switching element 10 is connected between the control electrode (base) of the transistor 51 and the negative output terminal h of the full-wave rectifier 4A. The avalanche diode 30 connected between the DC output terminals g and h of the full-wave rectifier 4A is for protecting the thyristor 52 and the transistor 51 from the pulse voltage generated at the time of cutting off the current in the switch circuit.

A diode 31, a voltage regulation switching element 32 such as an SSS which is turned on in response to a voltage higher than a predetermined level, a capacitor 33, resistors 34, 35, 36, a diode 37 and an avalanche diode 38 are newly added for supplying the electrode preheating current to the discharge lamp for starting the same. The resistors 34, 35 and 36 connected between the DC output terminals g and h of the full-wave rectifier 4A and the capacitor 33 make up an integrator circuit. The voltage regulation switching element 32 is connected between the output terminals of the integrator circuit. The anode of the diode 31 is connected to the current-flow-out terminal (cathode) of the thyristor 52 which is a switching element with a control electrode, and the cathode thereof is connected to the current flow-in terminal (anode) of the voltage regulation switching element 32.

In this configuration, the pulse voltage generated at the inductive ballast 2 at the time of cut off of the current flowing in the switching circuit by the transistor 51 has a comparably great pulse length when the discharge lamp 3 is not lighted, which pulse length is extremely narrowed by being absorbed into the discharge lamp 3 when the discharge lamp 3 is lighted. In the circuit of FIG. 26, this difference in pulse width is so utilized that the pulse voltage with considerable length generated at the inductive ballast 2 and produced between the DC output terminals g and h of the full-wave rectifier 4A only when the discharge lamp 3 is not lighted is integrated by the resistors 34, 35, 36 and the capacitor 33, and the resulting integrated voltage is used to turn on the voltage regulation element 32. Upon the turning on of the voltage regulation element 32, the trigger current from the resistor 142 causes the thyristor 52 to be turned on as mentioned later, so that the electrode preheating current flows in an electrode preheating circuit including the positive output terminal g of the full-wave rectifier 4A, the thyristor 52, the diode 31, the voltage regulation switching element 32 and the negative output terminal h of the full-wave rectifier 4A.

Figure 29A:
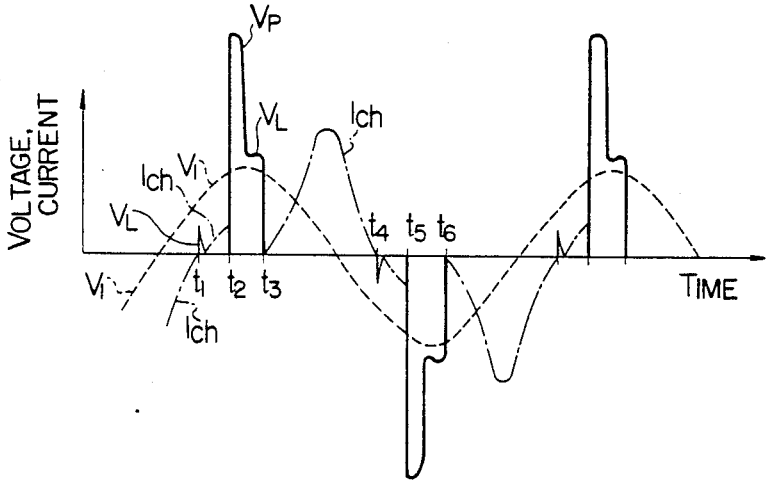
FIGS. 29A and 29B are diagrams for explaining the operation of the discharge lamp lighting device of FIG. 26.

The operation of this circuit will be explained with reference to FIGS. 29A and 29B. FIG. 29A shows waveforms of the voltage and current at the time of starting preheating, and FIG. 29B waveforms of the voltage and current when the discharge lamp 3 is lighted steadily. Character $V_1$ shows a source voltage, $V_p$ a pulse voltage generated, $V_L$ a voltage across the discharge lamp, $I_{Ch}$ a preheating current (ballast current), and $I_L$ a discharge lamp current.

FIG. 29A shows the condition in the process of the preheating operation. When the preheating current is flowing with both the thyristor 52 and the voltage regulation element 32 turned on, the reverse trigger switching element 10 is off. At the time $t_1$ when the preheating current $I_{Ch}$ is reduced to zero, the voltage across the discharge lamp 3 is also reduced to zero so that the thyristor 52 and the voltage regulation switching element 32 are turned on at the time $t_1$, in view of the fact that the noise-reducing capacitor 29 is connected across the discharge lamp 3 as shown in FIG. 26. After that, the voltage $V_L$ across the discharge lamp 3 increases rapidly again to the instantaneous value of the source voltage, with the result that the thyristor 52 and the transistor 51 are turned on by the trigger current from the resistors 142 and 141 respectively immediately after the time $t_1$. The current $I_{Ch}$ on the gradual increase thus flows to the inductive ballast 2 through the thyristor 52, the transistor 51, the diode 8 and the resistor 7 in that order. When this current reaches a predetermined value and the terminal voltage of the resistor 7 increases to a predetermined level, the base potential of the transistor 51 reaches the breakover voltage of the reverse trigger switching element 10, thus turning on the switching element 10. The transistor 51 is turned off at the time $t_2$, followed by the turning off of the thyristor 52 in response to the reverse trigger current flowing from the gate thereof to the resistor 141. At the same time, the pulse voltage $V_p$ generated in the inductive ballast 2 is applied between the terminals of the voltage regulation switching element 32 through an integrator circuit comprising the resistors 34, 35, 36 and the capacitor 33, so that the voltage regulation switching element 32 is turned on at the time $t_3$ after decrease of the pulse voltage. With the decrease of the voltage across the voltage regulation switching element 32, the cathode potential of the thyristor 52 is reduced below the gate potential thereof. Thus the thyristor 52 is also turned on by the trigger current from the resistor 142, so that the electrode preheating current $I_{Ch}$ flows in the circuit including the thyristor 6, the diode 31 and the voltage regulation switching element 32. The reverse trigger switching element 10 is turned off before the preheating current for the next half cycle stops flowing at time $t_4$. The switch circuit repeats this process of operation after time $t_4$.

By repetition of this operation, the electrode is preheated sufficiently and the discharge lamp 3 is lighted. Then the internal impedance of the discharge lamp is reduced, and the energy of the pulse generated at the time of turning off of the thyristor 52 and the transistor 51 is absorbed into the discharge lamp, thereby reducing both the amplitude and width of the pulse voltage $V_p$. As a result, the charge voltage of the capacitor 33 (integrated voltage) is reduced below the breakover voltage of the voltage regulation switching element 32, and the voltage regulation switching element 32 is no longer capable of being turned on, so that the preheating operation stops and transfer is made to the steady lighted condition.

Figure 29B:
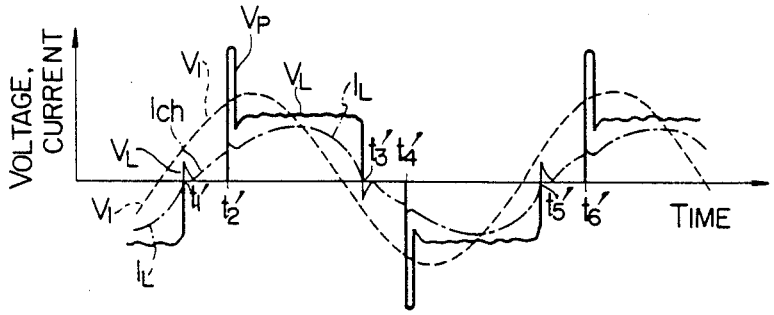

Under the steady lighted condition, as shown in FIG. 29B, the reverse trigger switching element 10 is turned off at the time $t_1'$ when the discharge lamp current $I_L$ is reduced to zero, and immediately after that, the thyristor 52 and the transistor 51 are turned on, thus supplying the ascending current to the inductive ballast 2. At the time $t_2'$ when the reverse trigger switching element 10 is turned on, the thyristor 52 and the transistor 51 are turned off. The pulse voltage $V_P$ generated in this process causes the discharge lamp 3 to be reignited and the discharge lamp current $I_L$ continues to flow till the time $t_3'$. This process of operation is repeated every half cycle thereafter.

During the periods $t_2'$–$t_3'$ and $t_4'$–$t_5'$ in FIG. 29B, the thyristor 52 is off and therefore the voltage regulation switching element 32 is not turned on by the pulse voltage $V_P$ or the following voltage $V_L$ across the discharge lamp 3, so that the loss which otherwise might occur by an extraneous preheating current is not caused when the discharge lamp is lighted.

The diode 31 is for preventing the charge electrons of the capacitor 33 from discharging through the cathode of the thyristor 52, the gate thereof, the resistor 141 and the reverse trigger switching element 10. The combination of the diode 31 and the voltage regulation switching element 32 makes it possible to configure an electrode preheating circuit having the switching function responding to the on and off conditions of the discharge lamp 3. When a voltage higher than a predetermined value is applied across the voltage regulation switching element 32, the voltage regulation switching element 32 is turned on and passes a required amount of preheating current. This on state is kept until the current is reduced to zero by the reversal of polarity of the source voltage. As far as this condition is satisfied, any type of element may be used as the voltage regulation switching element 32.

The diode 37 is for preventing the reverse trigger switching element 10 from losing the ability to turn off at the end of each half cycle by the charge voltage of the capacitor 33 which exists all the time. In order to accurately discriminate the on/off state of the discharge lamp, it is preferable that the integration voltage of the capacitor 33 applied to the silicon symmetrical switch 32 changes with the pulse width but not with the crest value of the pulse voltage $V_P$. This rather complicates the circuit configuration, but the use of a double integrator circuit makes it difficult for the integration voltage to be affected by the pulse crest values, thus permitting more accurate transfer from the preheating operation of the switch circuit to the lighted condition maintaining operation thereof. The lamp characteristics at the start of lighting depends on the ambient temperature, resulting in the change in the waveform of the pulse voltage $V_P$. Therefore, if the circuit constants are set to secure normal operation at a high temperature, the preheating ability is apt to be insufficient at low temperatures (especially in the range from 5° to 20° C.) The avalanche diode 38 is provided for the purpose of shaping the voltage waveform applied to the integrator circuit, by cutting the part of the pulse voltage $V_P$ beyond a predetermined level thereby to accomplish a satisfactory preheating operation even at low temperatures.

In FIG. 26, the anode of the diode 31 is connected to the cathode of the thyristor 52. Alternatively, the anode of the diode 31 may be connected to the emitter of the transistor 51. In this case, in order to enable the transistor 51 to turn on in response to the conduction of the voltage regulation switching element 32, the voltage drop across the reverse trigger switching element 10 turned on is required to be determined at a large value while at the same time increasing the current capacity and the current amplification factor $h_{FE}$ of the transistor 51 to a level sufficiently high to supply the preheating current. Instead of connecting the thyristor 52 and the transistor 51 in series with each other in FIG. 26, the transistor and the resistor 141 may be omitted to the extent that the thyristor 52 has a gate turn off characteristic capable of cutting off the conduction current thereof by a gate signal. Further, the thyristor 52 may be replaced by any other type of switching element with control electrode (such as bipolar transistor or MOS.FET) which has a sufficiently large amplification factor and a high breakdown voltage not to succumb to the pulse voltage required for starting the discharge lamp.

Figure 27:
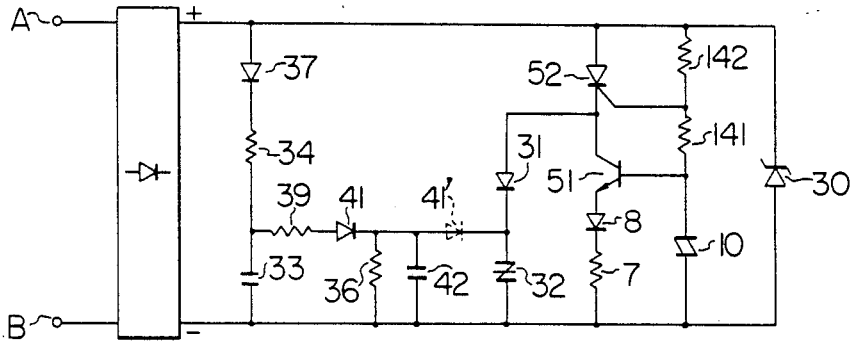
FIG. 27 is a circuit diagram showing another example of the configuration of the switch circuit included in the discharge lamp lighting device shown in FIG. 26.

A circuit of a still further embodiment of the present invention is shown in FIG. 27. This embodiment is designed to accomplish normal preheating operation in the case where the turn on gate sensitivity of the thyristor 52 is low or the latching current of the voltage regulation switching element 32 is large. In order to supply the preheating current to the electrode preheating circuit, the turning on of the voltage regulation switching element 32 is required to be followed by the turning on of the thyristor 52. If the gate sensitivity of the thyristor 52 is low, however, it takes a long time before this required turning on of the occurs. Therefore, the turned on condition of the voltage regulation switching element 32 is required to be lengthened to the time when the thyristor 52 is turned on. In FIG. 27, the resistor 39 and the capacitor 33 make up a CR time constant circuit for lengthening the turned on condition of the voltage regulation switching element 32.

Numeral 41 shows a diode for assuring the turn off operation of the thyristor 52. If the cathode current of the thyristor 52 flows into the capacitor 33 after the turning off of the transistor 51, it is required that the current in the thyristor 52 capable of being turned off by a gate signal thereof must be larger than that for the turning off operation when the ordinary cathode current is zero. For this reason, it sometimes happens that an ordinary thyristor is incapable of being turned off. In the circuit of FIG. 27, the diode 41 prevents the cathode current of the thyristor 52 from flowing into the capacitor 33. If the resistor 39 has a sufficiently large resistance value, the diode 41 is not necessary.

Numeral 42 shows a capacitor of very small capacity, say, about 1000 pF which is provided for turning on the voltage regulation switching element 32 of a large latching current without fail.

Figure 28:
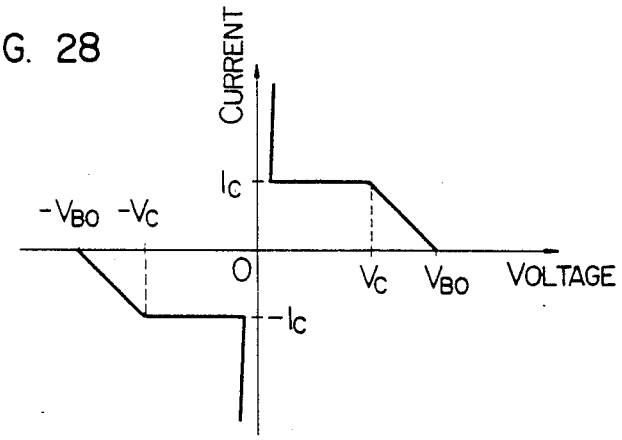
FIG. 28 is a graph showing the voltage-current characteristic curve of a silicon symmetrical switch (SSS) element used in the switch circuit shown in FIGS. 26 and 27.

The voltage-current characteristic of an SSS used as the voltage regulation switching element 32 is generally as shown in FIG. 28. Even when the voltage of the capacitor 33 reaches the breakover voltage $V_{BO}$ of the voltage regulation switching element 32, namely, an SSS in the course of a preheating operation, the current flowing in the resistor 39 does not increase beyond $I_C$ so that the SSS 32 is not turned on if the resistance value of the resistor 39 is larger than the value determined by the gradient of the SSS characteristic curve in the range from $V_C$ to $V_{BO}$ in the drawing. In the case where the capacitor 42 is connected across the SSS, however, the current larger than $I_C$ instantaneously flows in the SSS and it is turned on if the voltage of the capacitor 42 reaches $V_{BO}$. As a result, a voltage substantially corresponding to $V_{BO}$ is applied to the resistor 39, and the current in the SSS 32 is maintained higher than $I_C$ until the thyristor 52 is turned on. In other words, the resistance value of the resistor 39 can be set sufficiently large as compared with the case in the absence of the capacitor 42, so that the capacitance of the integrating capacitor 33 can be reduced, thus making it possible to increase the value of the resistor 34 for a reduced loss due to it. The diode 41 may alternatively be connected at position designated by 41' with almost equal effect.

It will be understood from the foregoing description that according to the embodiments of the present invention, a discharge lamp lighting device with an electrode preheating circuit is available in which a sufficient amount of preheating current is supplied at the time of starting the discharge lamp with a simple configuration using a voltage regulation switching element and a diode. Further, since no preheating current flows when the lamp is lighted, power is not lost.

We claim:

1. A discharge lamp lighting device comprising a series closed-loop circuit including an AC power supply, a ballast having an inductance, and a discharge lamp and a switch circuit connected in parallel to said discharge lamp; in which said switch circuit includes a full-wave rectifier connected across said discharge lamp, a first thyristor connected in series with a first impedance circuit between output terminals of said full-wave rectifier and being capable of being turned off by a gate signal, said first impedance circuit being connected at its one terminal in series to a cathode of said first thyristor, a second thyristor connected between a gate of said first thyristor and the other terminal of said first impedance circuit, and a second impedance circuit connected between a gate of said second thyristor and the cathode of said first thyristor.

2. A discharge lamp lighting circuit according to claim 1, in which said second impedance circuit includes at least a capacitor.

3. A discharge lamp lighting device according to claim 1, in which said first impedance circuit comprises a parallel circuit including a resistor and a capacitor.

4. A discharge lamp lighting device comprising a series closed-loop circuit including an AC power supply, a ballast having an inductance, and a discharge lamp, and a switch circuit connected in parallel to said discharge lamp; in which said switch circuit comprises a full-wave rectifier connected across said discharge lamp, a main thyristor connected in series with a first impedance circuit between output terminals of said full-wave rectifier and being capable of being turned off by a gate signal, said first impedance circuit being formed by a parallel circuit connected at its one terminal in series to a cathode of said main thyristor and including a resistor and a capacitor, an auxiliary switching element connected between the gate of said main thyristor and the other terminal of said first impedance circuit, a preheating thyristor connected in parallel to said first impedance circuit, and means connected to said full-wave rectifier for firing said preheating thyristor, said main thyristor being capable of being turned on again when said preheating thyristor is turned on even when said auxiliary switching element is conducting.

5. A discharge lamp lighting device comprising a series closed-loop circuit including an AC power supply, a ballast choke coil and a discharge lamp, and a switch circuit connected in parallel to said discharge lamp; in which said switch circuit includes a full-wave rectifier connected across said discharge lamp, a first thyristor connected in series with a transistor and a first impedance circuit across the output terminals of said full-wave rectifier, said thyristor having a gate electrode and being capable of being turned off by a gate signal applied to said gate electrode, means including a semiconductor switching element connected in series with a second impedance circuit between the gate electrode of said thyristor and the output terminal of said full-wave rectifier to which said first impedance circuit is connected, the point of series connection of said semiconductor switching element and said second impedance circuit being connected to the base of said transistor.

6. A discharge lamp lighting device according to claim 5, further including a preheating thyristor having a gate electrode and being connected across the series circuit of said transistor and said first impedance circuit, and a trigger circuit connected between the output of said full-wave rectifier and the gate electrode of said preheating thyristor for controlling the conduction thereof.

7. A discharge lamp lighting device according to claim 6, wherein said trigger circuit includes an integrator circuit connected across the output terminals of said full-wave rectifier, a further semiconductor switching element connected between the output of said integrator circuit and the gate electrode of said preheating thyristor and a third impedance circuit connected between the gate electrode and cathode of said preheating thyristor.

8. A discharge lamp lighting device comprising a series closed-loop circuit including an AC power supply, a ballast choke coil, and a discharge lamp, and a switch circuit connected in parallel to said discharge lamp; in which said switch circuit includes a full-wave rectifier connected across said discharge lamp, a first thyristor connected in series with a first impedance circuit between output terminals of said full-wave rectifier and being capable of being turned off by a gate signal, said first impedance circuit having a first resistor and being connected at its one end terminal to the cathode of said first thyristor, means including a second resistor connected between a positive output terminal of said full-wave rectifier and the gate of said first thyristor for applying to said first thyristor a turn-on signal when the voltage across said discharge lamp is slightly increased from zero, means including a semiconductor switching element connected between a gate of said first thyristor and the other end terminal of said first impedance circuit, and a second impedance circuit connected between the cathode of said first thyristor and a control gate of said semiconductor switching element, said second impedance circuit including means for supplying a current to the control gate of said semiconductor switching element to turn on the same when a current flowing through said first impedance circuit reaches a value which causes a predetermined voltage to be developed across said first impedance circuit, thereby turning on said semiconductor switching element and causing said first thyristor to turn off, whereby said first thyristor is turned on at the time point when the voltage applied across said discharge lamp is substantially reduced to zero and then turned off at a time point when the current flowing in said first thyristor reaches a predetermined value.

9. A discharge lamp lighting device according to claim 8, wherein said first thyristor is connected in cascade with at least a second thyristor capable of being turned off by a gate signal.

10. A discharge lamp lighting device comprising a series closed-loop circuit including an AC power supply, a ballast choke coil, and a discharge lamp, and a switch circuit connected in parallel to said discharge lamp; in which said switch circuit includes a full-wave rectifier connected across said discharge lamp, a first thyristor connected in series with a first impedance circuit between output terminals of said full-wave rectifier and being capable of being turned off by a gate signal, said first impedance circuit having a first resistor and being connected at its one end terminal to the cathode of said first thyristor, a preheating thyristor connected between the cathode of said first thyristor and one output terminal of said full-wave rectifier where said first impedance circuit is connected and means including a semiconductor switching element connected between a gate of said first thyristor and the other end terminal of said first impedance circuit, whereby said first thyristor is turned on at the time point when the voltage applied across said discharge lamp is substantially reduced to zero and then turned off at a time point when the current flowing in said first thyristor reaches a predetermined value.

11. A discharge lamp lighting device comprising a series closed-loop circuit including an AC power supply, a ballast choke coil, and a discharge lamp, and a switch circuit connected in parellel to said discharge lamp; in which said switch circuit includes a full-wave rectifier connected across said discharge lamp, a first thyristor connected in series with a first impedance circuit between output terminals of said full-wave rectifier and being capable of being turned off by a gate signal, said first impedance circuit having a first resistor and being connected at its one end terminal to the cathode of said first thyristor, and means including a semiconductor switching element connected between a gate of said first thyristor and the other end terminal of said first impedance circuit, said semiconductor switching element comprising a second thyristor, the gate of which is connected to said first impedance circuit terminal of said first thyristor side through a second impedance circuit including a capacitor, whereby said first thyristor is turned on at the time point when the voltage applied across said discharge lamp is substantially reduced to zero and then turned off at a time point when the current flowing in said first thyristor reaches a predetermined value.

* * * * *